US009858749B2

(12) United States Patent
Delekta

(10) Patent No.: US 9,858,749 B2
(45) Date of Patent: Jan. 2, 2018

(54) GAMING DEVICE AND METHODS OF ALLOWING A PLAYER TO PLAY A GAMING DEVICE HAVING REELS WITH SYMBOL SELECTION AREAS

(71) Applicant: Konami Gaming, Inc., Las Vegas, NV (US)

(72) Inventor: Scott Delekta, Las Vegas, NV (US)

(73) Assignee: KONAMI GAMING, INC., Las Vegas, NV (US)

( * ) Notice: Subject to any disclaimer, the term of this patent is extended or adjusted under 35 U.S.C. 154(b) by 0 days.

(21) Appl. No.: 14/189,000

(22) Filed: Feb. 25, 2014

(65) Prior Publication Data

US 2015/0050983 A1 Feb. 19, 2015

(30) Foreign Application Priority Data

Aug. 16, 2013 (AU) ..... 2013216675

(51) Int. Cl.
*G07F 17/32* (2006.01)

(52) U.S. Cl.
CPC ..... *G07F 17/3213* (2013.01)

(58) Field of Classification Search
CPC ..... G07F 17/32; G07F 17/34
USPC ..... 463/16–20, 25, 42
See application file for complete search history.

(56) References Cited

U.S. PATENT DOCUMENTS 5,395,111 A 3/1995 Inoue
6,726,204 B2 4/2004 Inoue
6,880,826 B2 4/2005 Inoue
7,344,442 B2 3/2008 Inoue
7,351,143 B2 4/2008 Inoue
7,473,173 B2 1/2009 Peterson et al.
7,559,837 B1 * 7/2009 Yoseloff et al. ..... 463/21
7,591,724 B2 9/2009 Baerlocher
(Continued)

FOREIGN PATENT DOCUMENTS

CN 1589943 A 3/2005
JP 2000-334118 A 12/2000
(Continued)

OTHER PUBLICATIONS

Patent Examination Report No. 1 (AU 2013216675)—dated Oct. 18, 2013.

(Continued)

*Primary Examiner* — Omkar Deodhar
*Assistant Examiner* — Shauna-Kay Hall
(74) *Attorney, Agent, or Firm* — Howard & Howard Attorneys PLLC

(57) ABSTRACT

A method for allowing a player to play a slot game with a gaming device is described herein. The method includes randomly generating an outcome of the game, wherein the outcome includes a first outcome and a second outcome. The method includes spinning and stopping the plurality of reels to display the first outcome, detecting an appearance of a symbol selection area in the first outcome, and responsively selecting at least one symbol for display in the symbol selection area. The method also includes displaying the second outcome including the first outcome and the selected at least one symbol being displayed in the symbol selection area and providing an award to the player as a function of the second outcome.

22 Claims, 11 Drawing Sheets

(56) References Cited

U.S. PATENT DOCUMENTS

| | | | | |
|---|---|---|---|---|
| 7,753,773 | B2 | 7/2010 | Baerlocher et al. | |
| 7,850,520 | B2 | 12/2010 | Yoshimi | |
| 7,862,422 | B2 | 1/2011 | Garamendi et al. | |
| 7,922,573 | B2 | 4/2011 | Baerlocher et al. | |
| 8,092,296 | B2 | 1/2012 | Inoue | |
| 8,235,796 | B2 | 8/2012 | Nakamura | |
| 2003/0224850 | A1 | 12/2003 | Anderson et al. | |
| 2004/0014516 | A1 | 1/2004 | Inoue | |
| 2004/0014517 | A1 | 1/2004 | Inoue | |
| 2004/0017041 | A1 | 1/2004 | Inoue | |
| 2005/0020349 | A1 | 1/2005 | Tachikawa | |
| 2005/0043084 | A1 | 2/2005 | Inoue | |
| 2005/0119043 | A1 | 6/2005 | Berman et al. | |
| 2006/0046830 | A1* | 3/2006 | Webb | 463/20 |
| 2006/0058097 | A1* | 3/2006 | Berman et al. | 463/20 |
| 2006/0073879 | A1 | 4/2006 | Baerlocher | |
| 2006/0084498 | A1* | 4/2006 | Baerlocher et al. | 463/20 |
| 2006/0135245 | A1 | 6/2006 | Hedrick et al. | |
| 2007/0054727 | A1 | 3/2007 | Garamendi et al. | |
| 2007/0105611 | A1* | 5/2007 | O'Halloran | 463/16 |
| 2008/0132321 | A1* | 6/2008 | Pau | 463/20 |
| 2009/0226417 | A1 | 9/2009 | Baum et al. | |
| 2009/0227357 | A1 | 9/2009 | Rasmussen | |
| 2010/0075740 | A1 | 3/2010 | Suda | |
| 2011/0223985 | A1 | 9/2011 | Mizue | |

FOREIGN PATENT DOCUMENTS

| | | | |
|---|---|---|---|
| JP | 2002-143432 | A | 5/2002 |
| JP | 2008-49141 | A | 3/2008 |
| WO | 2014/028866 | A2 | 2/2014 |

OTHER PUBLICATIONS

Patent Examination Report No. 1 (AU 2014202023)—dated May 12, 2014.

Australian Patent Examination Report No. 2 for Australian Patent Application No. 2014259502 dated Nov. 3, 2015.

Japanese Office Action (Application No. P2014-151900); dated Jul. 28, 2015.

Office Action with English Translation (Application No. I/1262); dated Jul. 20, 2015.

Patent Examination Report No. 3 (AU 2014259502) dated Nov. 26, 2015.

Patent Examination Report No. 1 (AU 2015264907); dated Nov. 14, 2016.

European Search Report (EP Appln. No. 14767332.1); dated Apr. 11, 2016.

* cited by examiner

GAMING DEVICE AND METHODS OF ALLOWING A PLAYER TO PLAY A GAMING DEVICE HAVING REELS WITH SYMBOL SELECTION AREAS

CROSS REFERENCE TO RELATED APPLICATION

This application claims priority to Australian Patent Application No. 2013216675, filed Aug. 16, 2013, the disclosure of which is hereby incorporated by reference in its entirety

TECHNICAL FIELD

The subject matter disclosed herein relates generally to gaming devices and more particularly, to an apparatus and method for allowing players to play a game having reels including symbol selection areas.

BACKGROUND OF THE INVENTION

Known gaming devices include a video display device to display a reel game that includes a plurality of reels with each reel including a plurality of symbols. During game play, the gaming device accepts a wager from a player, the player selects one or more paylines, the gaming device spins the reels, and sequentially stops each reel to display a combination of symbols on the reels. The gaming device then awards the player an award based on the combination of symbols orientated along the selected payline.

At least some known gaming devices display a game that includes at least one reel being displayed with a plurality of special symbols to increase the probability of a player winning an award. Over time, however, the player may become frustrated because of the limited number of symbols appearing on the game reels and the limited number of chances of obtaining an award. Accordingly, new features are necessary to appeal to player interest and enhance excitement in order to entice longer play and increased profitability. The present invention is directed to satisfying these needs.

SUMMARY OF THE INVENTION

In one aspect of the present invention, a method of allowing a player to play a slot game with a gaming device is provided. The method includes the steps of displaying, on a display device, a game that includes a plurality of reels being displayed in a display area. Each reel of the plurality of reels including a reel strip that has a plurality of symbols positions. At least one reel includes a reel strip having at least one symbol selection area that includes at least one symbol position. The method includes randomly generating an outcome of the game. The outcome includes a first outcome and a second outcome. The method includes spinning and stopping the plurality of reels to display the first outcome, detecting an appearance of a symbol selection area in the first outcome, wherein the symbol selection area includes a selection characteristic, and responsively selecting at least one symbol for display in the symbol selection area as a function of the selection characteristic. The method also includes displaying the second outcome including the first outcome and the selected symbol being displayed in the symbol selection area and providing an award to the player as a function of the second outcome.

In another aspect of the present invention, a gaming device is provided. The gaming device includes a display device for displaying a game, a user input device configured to generate a signal indicative of a player's selection input, and a controller that is coupled to the display device and the user input device. The controller is configured to display the game on the display device including a plurality of reels being displayed in a display area. Each reel of the plurality of reels includes a reel strip having a plurality of symbols positions. At least one reel includes a reel strip that has at least one symbol selection area that includes at least one symbol position. The controller randomly generates an outcome of the game. The outcome includes a first outcome and a second outcome. The controller spins and stops the plurality of reels to display the first outcome and detects an appearance of a symbol selection area in the first outcome. The symbol selection area includes a selection characteristic. The controller selects at least one symbol for display in the symbol selection area as a function of the selection characteristic, displays the second outcome including the first outcome and the selected symbol being displayed in the symbol selection area, and provides an award to the player as a function of the second outcome.

In yet another aspect of the present invention, one or more non-transitory computer-readable storage media, having computer-executable instructions embodied thereon, is provided. The computer-executable instructions cause a processor to display, on a display device, a game that includes a plurality of reels being displayed in a display area. Each reel of the plurality of reels includes a reel strip having a plurality of symbols positions. At least one reel includes a reel strip having at least one symbol selection area. The symbol selection area includes at least one symbol position. The processor randomly generates an outcome of the game that includes a first outcome and a second outcome. The processor spins and stops the plurality of reels to display the first outcome, detects an appearance of a symbol selection area in the first outcome, wherein the symbol selection area including a selection characteristic, selects at least one symbol for display in the symbol selection area as a function of the selection characteristic, displays the second outcome including the first outcome and the selected symbol displayed in the symbol selection area, and provides an award to the player as a function of the second outcome.

BRIEF DESCRIPTION OF THE DRAWINGS

Other advantages of the present invention will be readily appreciated as the same becomes better understood by reference to the following detailed description when considered in connection with the accompanying drawings wherein.

Corresponding reference characters indicate corresponding parts throughout the drawings.

DETAILED DESCRIPTION OF THE PREFERRED EMBODIMENT

Figure 1:
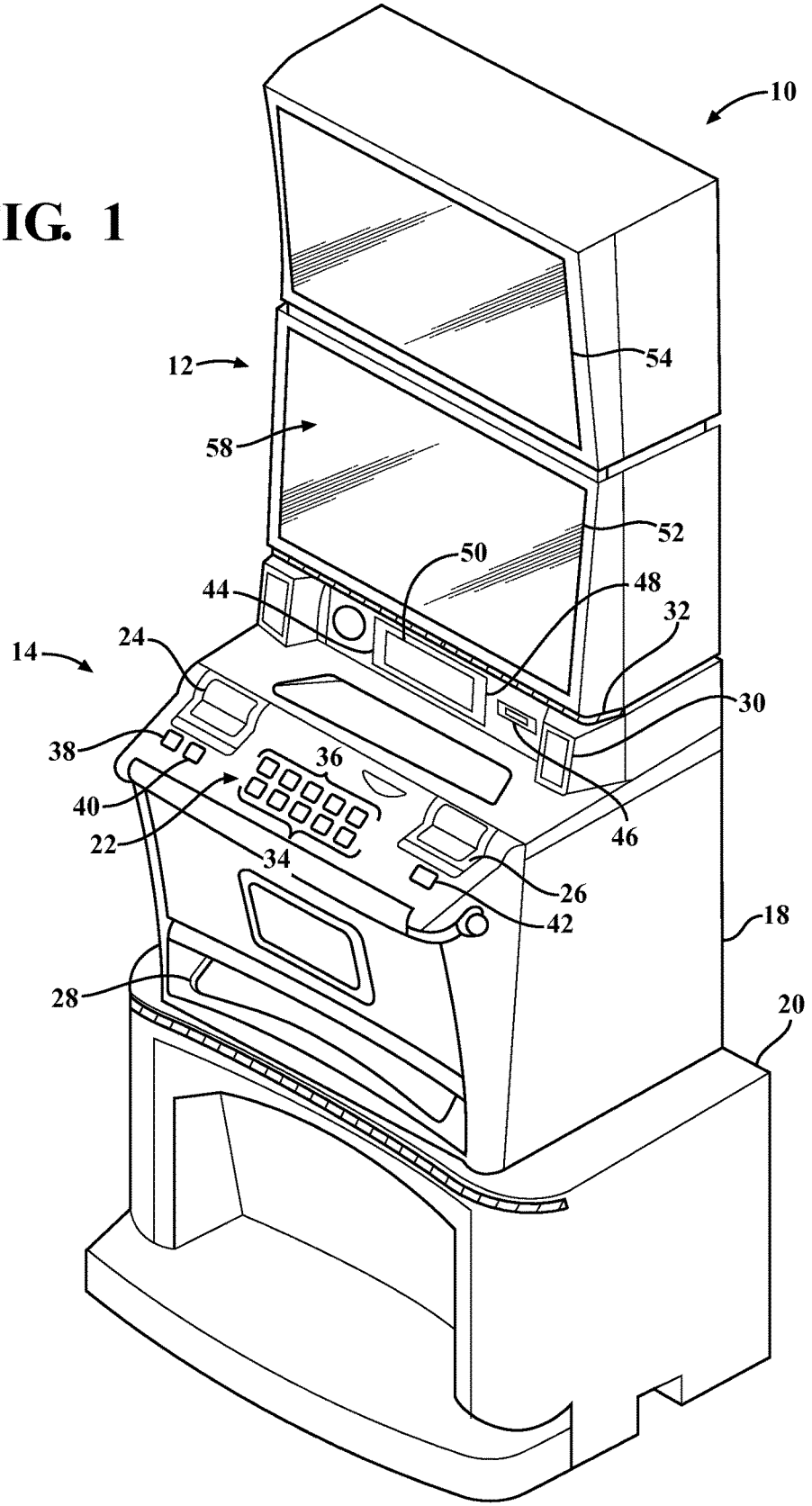
FIG. 1 is a perspective view of an exemplary gaming device of the present invention.

With reference to the drawings and in operation, the present invention overcomes at least some of the disadvantages of known gaming devices by providing a gaming device that displays a slot game that includes a reel having a symbol selection area that randomly displays additional symbols in the reel. In addition, the gaming device selects one or more symbols to be displayed in the symbol selection area based on a selection characteristic associated with the symbol selection area. More specifically, the gaming device randomly generates a game outcome, spins and stops the reels to display an intermediate outcome, detects the appearance of the symbol selection area in the intermediate outcome, responsively selects symbols to be displayed in the symbol selection area based on the associated selection characteristic, and displays a final game outcome including the intermediate outcome and the selected symbols. By providing a gaming device that displays an intermediate game outcome, and subsequently selects symbols for use in the final game outcome, the gaming device provides an increased probability of achieving a win over known gaming machines and reduces the burden on a game designer. Thus, the amount of time that the game is played by patrons of a gaming establishment is thereby increased, thus increasing an overall profitability of the gaming establishment.

In general, the gaming device displays a game that includes a reel that has a primary reel strip and a secondary reel strip. The primary reel strip includes a plurality of symbols and a symbol selection area, and the second reel strip includes a plurality of symbols that may be displayed within the symbol selection area. The gaming device randomly generates an outcome of the game and spins and stops the reel to display an intermediate outcome that shows a portion of the final game outcome. The gaming device detects the appearance of the symbol selection area in the intermediate outcome and selects a symbol from the secondary reel strip to be displayed within the symbol selection area. The gaming device then displays the final game outcome including the selected symbols being displayed in the symbol selection area. By providing a gaming device that displays an intermediate outcome, the player's expectation for achieving a win is increased and the enjoyment of the game is improved. Moreover, the player can anticipate a potential winning combination as combination of symbols are displayed in the intermediate game outcome. Thus, the amount of time that the game is played by patrons of a gaming establishment is thereby increased.

A selected embodiment of the present invention will now be explained with reference to the drawings. It will be apparent to those skilled in the art from this disclosure that the following description of the embodiment of the present invention is provided for illustration only and not for the purpose of limiting the invention as defined by the appended claims and their equivalents.

Figure 2:
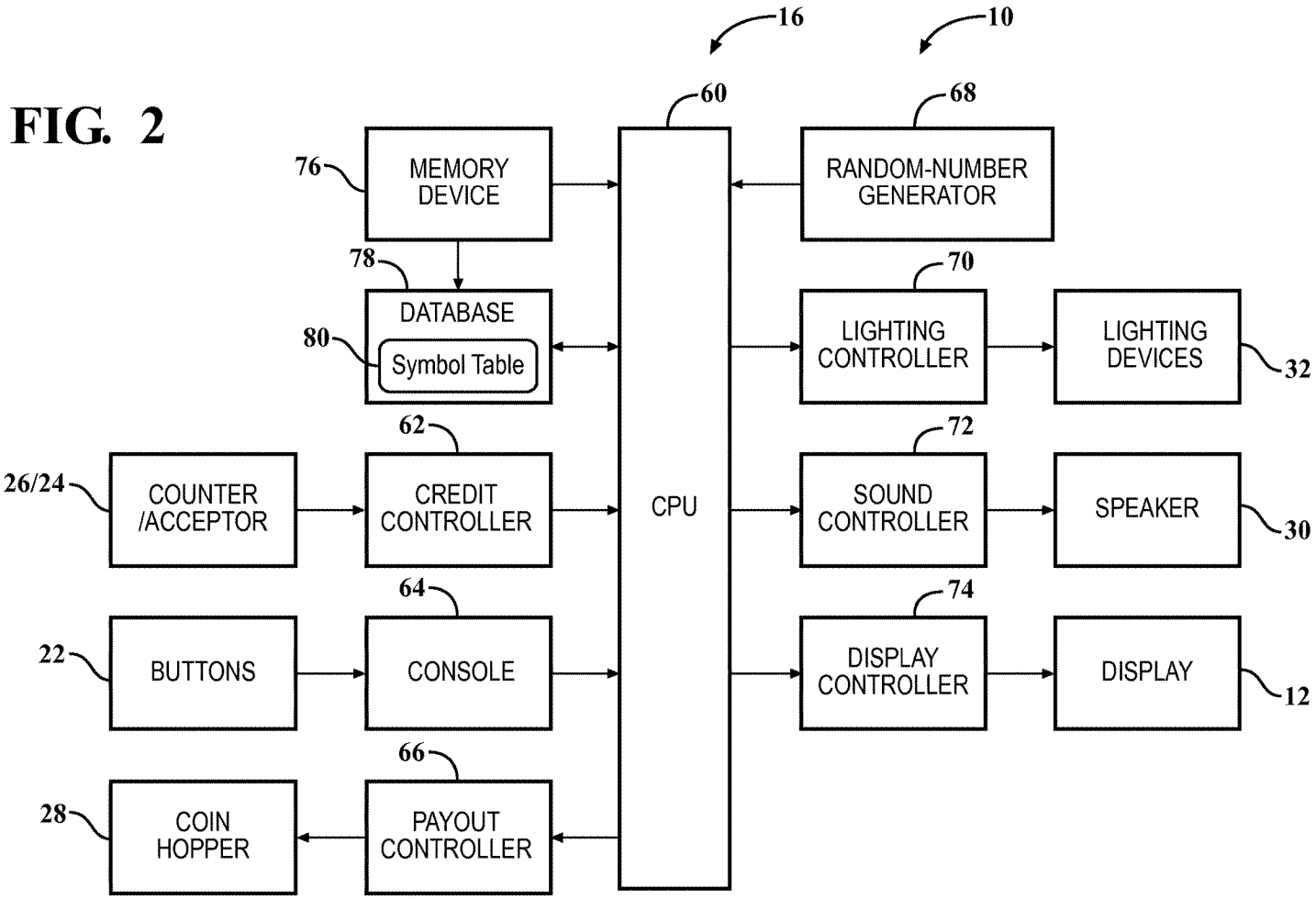
FIG. 2 is a schematic representation of the gaming device shown in FIG. 1.

FIG. 1 is a perspective view of an exemplary gaming device 10. FIG. 2 is a schematic representation of the gaming device 10. A preferred embodiment of the present invention is an electronic gaming machine preferably installed in a casino. In the illustrated embodiment, the gaming device 10 includes a display device 12 for displaying a plurality of games, a user input device 14 to enable a player to interface with the gaming device 10, and a gaming controller 16 that is operatively coupled to the display device 12 and the user input device 14 to enable a player to play games displayed on the display device 12. The gaming device 10 also includes a cabinet assembly 18 that is configured to support the display device 12, the user input device 14, and/or the gaming controller 16 from a gaming stand 20 and/or a supporting surface.

The display device 12 and the user input device 14 are each coupled to the cabinet assembly 18 and are each accessible by the player. In one embodiment, the gaming controller 16 is positioned within the cabinet assembly 18. Alternatively, the gaming controller 16 may be separated from the cabinet assembly 18, and connected to components of the gaming device 10 through a network such as, for example, a local area network (LAN), a wide area network (WAN), dial-in-connections, cable modems, wireless modems, and/or special high-speed Integrated Services Digital Network (ISDN) lines.

In one embodiment, the user input device 14 includes a plurality of input buttons 22, a coin slot 24, and/or a bill acceptor 26. The coin slot 24 includes an opening that is configured to receive coins and/or tokens deposited by the player into the gaming device 10. The gaming device 10 converts a value of the coins and/or tokens to a corresponding amount of gaming credits that are used by the player to wager on games played on the gaming device 10.

The bill acceptor 26 includes an input and output device that is configured to accept a bill, a ticket, and/or a cash card into the bill acceptor 26 to enable an amount of gaming credits associated with a monetary value of the bills, ticket, and/or cash card to be credited to the gaming device 10. Moreover, the gaming device 10 may also utilize a cashless wagering system (not shown), such as a ticket in ticket out (TITO) system (not shown). In one embodiment, the bill acceptor 26 also includes a printer (not shown) that is configured to dispense a printed voucher ticket that includes information indicative of an amount of credits and/or money paid out to the player by the gaming device 10 during a gaming session. The voucher ticket may be used at other gaming devices, or redeemed for cash, and/or other items as part of a casino cashless system (not shown).

A coin tray 28 is coupled to the cabinet assembly 18 and is configured to receive a plurality of coins that are dispensed from the gaming device 10. One or more speakers 30 are installed inside the cabinet assembly 18 to generate voice announcements and/or sound effects associated with game play. The gaming device 10 also includes one or more lighting devices 32 that are configured to blink and/or change brightness and color in specific patterns to produce lighting effects to enhance a visual gaming experience for the player.

In one embodiment, the input buttons 22 include a plurality of BET switches 34 for inputting a wager on a game, a plurality of selection switches 36 for selecting a betting line, a payline, and/or card, a MAXBET switch 38 for inputting a maximum wager, a PAYOUT switch 40 for ending a gaming session and dispensing accumulated gaming credits to the player, and a start switch, i.e., a SPIN/DEAL button 42 to initiate an output of a game.

In the illustrated embodiment, the BET switches 34 include five switches from 1BET to 5BET to enable a player to wager between a minimum bet up to 5× minimum bet. Each selection switch 36 corresponds to a betting line such as, for example, a payline and/or symbol for a reel game, one or more cards for a card game, and/or a symbol for a roulette game, to enable a player to associate a wager with one or more betting lines. The MAXBET switch 38 enables a player to input the maximum bet that a player can spend against one play of a game. The PAYOUT switch 40 enables a player to receive the amount of money and/or credits awarded to the player during a gaming session, which has been credited onto the gaming device 10.

The gaming device 10 also includes a player tracking device 44 that is coupled to the gaming controller 16 for identifying the player and/or a player tracking account that is associated with the player. The player tracking account may include, but is not limited to, gaming credits available to the player for use in playing the gaming device 10. The player tracking device 44 is configured to communicate player account information between a player tracking controller (not shown) and the gaming device 10. For example, the player tracking device 44 may be used to track bonus points and/or credits awarded to the player during a gaming session and/or track bonus and/or credits downloaded to the gaming device 10 from the player tracking system. In the illustrated embodiment, the player tracking controller assigns a player status, e.g. a player ranking, based on the player account information. For example, the player tracking information may include, but is not limited to, a frequency in which the player plays a game, the average wager the player makes per play of a game, a total amount wagered by the player over a predefined period of time, and/or any other suitable player tracking information.

The player tracking device 44 is coupled to the gaming cabinet assembly 18 and includes a player identification card reader 46, a data display 48, and a keypad 50. The player identification card reader 46 is configured to accept a player tracking card (not shown) inserted by the player, and read information contained on the player tracking card to identify the player account information. The player identification card reader 46 may include, but is not limited to, a barcode reader, a magnetic card reader, and/or a radio frequency identification (RFID) card reader. The keypad 50 is configured to accept a user selection input such as, for example, a unique player personal identification number (PIN) to facilitate enabling the gaming device 10 to identify the player, and access player account information associated with the identified player to be displayed on the data display 48. In one embodiment, the data display 48 includes a touchscreen panel that includes the keypad 50. Alternatively, the data display 48 and the keypad 50 may be included in the display device 12.

In one embodiment, the display device 12 includes a first display 52 and a second display 54. The first display 52 is configured to display a game 56 on a game screen 58 (shown in FIGS. 3-5) including indicia and/or symbols for use in the game 56, e.g., cards used by a card game, roulette wheel and symbols used in a roulette game, and reels used in a reel game. The game 56 may include any type of game including, but not limited to, a video slot game, a keno game, a blackjack game, a video poker game, or any type of game which allows a player to make a wager, play a game, and potentially provide the player an award based on an outcome of the game and a paytable. The second display 54 is configured to display game play instructions for performing the game 56 including, but not limited to, playing instructions, paytables, paylines, betting lines and/or any other information to enable the gaming device 10 to function as described herein. Moreover, each display 52 and 54 may be configured to display at least a portion of the game screen 58 and/or game play instructions. In one embodiment, the first and second displays 52 and 54 each include a flat panel display, such as a cathode ray tube display (CRT), a liquid crystal display (LCD), a light-emitting diode display (LED), an organic light-emitting diode display (OLED), an active-matrix organic light-emitting diode display (AMOLED), a plasma display, and/or any suitable visual output device capable of displaying graphical data and/or text to a user. Alternatively, a single component, such as a touch screen, may function as both the display device 12 and as the user input device 14. In an alternative embodiment, the first display 52 and/or the second display 54 includes a plurality of mechanical reels displaying a plurality of game symbols.

Referring to FIG. 2, in one embodiment, the gaming controller 16 includes a processor, i.e., a central processing unit (CPU) 60, a credit controller 62, a console unit 64, a payout controller 66, a random-number generator (RNG) 68, a lighting controller 70, a sound controller 72, a display controller 74, a memory device 76, and a database 78. The memory device 76 includes a computer readable medium, such as, without limitation, random access memory (RAM), read-only memory (ROM), erasable programmable read-only memory (EPROM), flash memory, a hard disk drive, a solid state drive, a diskette, a flash drive, a compact disc, a digital video disc, and/or any suitable device that enables the CPU 60 to store, retrieve, and/or execute instructions and/or data.

The CPU 60 executes various programs, and thereby controls other components of the gaming controller 16 according to player instructions and data accepted by the user input device 14. The CPU 60 in particular executes a game program, and thereby conducts a game in accordance with the embodiments described herein. The memory device 76 stores programs and databases used by the CPU 60. Moreover, the memory device 76 stores and retrieves information in the database 78 including, but not limited to, wagers, wager amounts, average wagers per game, a game type, a number of reels associated with a game, a number of reel strips associated with each reel, a number of symbols being displayed on each reel strip, a number of symbol selection areas associated with each reel strip, a selection characteristic associated with each symbol selection area, a type of symbol being displayed on a reel strip, a predefined set of normal symbols, a predefined set of special symbols, a number of symbol cells being displayed with each game, image data for producing game images and/or screens on the display device 12, and temporarily stores variables, parameters, and the like that are used by the CPU 60. In addition, the memory device 76 stores indicia, symbol weights, symbol values, selection probability tables which represent relationships between symbol selection probabilities and symbol selection area characteristics, paytables, and/or winning combination tables which represent relationships between combinations of random numbers and types of awards. In the illustrated embodiment, the database 78 also includes a symbol selection table 80 that includes a list including a predefined set of game symbols and a list of selection characteristics associated with each of the predefined set of symbols. In addition, the symbol selection table 80 may also include a selection probability associated with each game symbol and each corresponding selection characteristic. In one embodiment, the memory device 76 utilizes RAM to temporarily store programs and data necessary for the progress of the game 56, and EPROM to store, in advance, programs and data for controlling basic operation of the gaming device 10, such as the booting operation thereof.

The credit controller 62 manages the amount of player's credits, which is equivalent to the amount of coins and bills counted and validated by the bill acceptor 26. The console unit 64 is coupled to the user input device 14 to monitor player selections received through the input buttons 22, and accept various instructions and data that a player enters through the input buttons 22. The payout controller 66 converts a player's credits to coins, bills, or other monetary data by using the coin tray 28 and/or for use in dispensing a credit voucher via the bill acceptor 26.

The lighting controller 70 controls one or more lighting devices 32 to blink and/or change brightness and color in specific patterns in order to produce lighting effects associated with game play. The sound controller 72 controls the speakers 30 to output voice announcements and sound effects during game play. The display controller 74 controls the display device 12 to display various images on the game screen 58 preferably by using computer graphics and image data stored in the memory device 76. More specifically, the display controller 74 controls video reels in a game screen displayed on the first display 52 and/or the second display 54 by using computer graphics and the image data. In another embodiment, the display device 12 includes a plurality of mechanical reels. The display controller 74 is configured to control a rotation of each of the plurality of mechanical reels to spin and stop each reel to display a game outcome.

The RNG 68 generates and outputs random numbers to the CPU 60 preferably at the start of each round of a game. The CPU 60 uses the random numbers to determine an outcome of the games. For example, if the game is a video slot game, the CPU 60 uses the RNG 68 to randomly select an arrangement of symbols to be displayed on video reels. Moreover, the CPU 60 generally uses random numbers generated by the RNG 68 to play the games and to determine whether or not to provide an award to a player. In one embodiment, the CPU 60 may also use the random numbers to determine a stop position of each reel for use in stopping each of a plurality of mechanical reels being displayed in the display device 12 to display the game outcome. In addition, the CPU 60 generates game outcomes including combinations of random numbers, and compares the generated combinations with winning combinations stored in the winning combination table to determine if the generated outcome is a winning outcome that is associated with a type of award.

Figure 3:
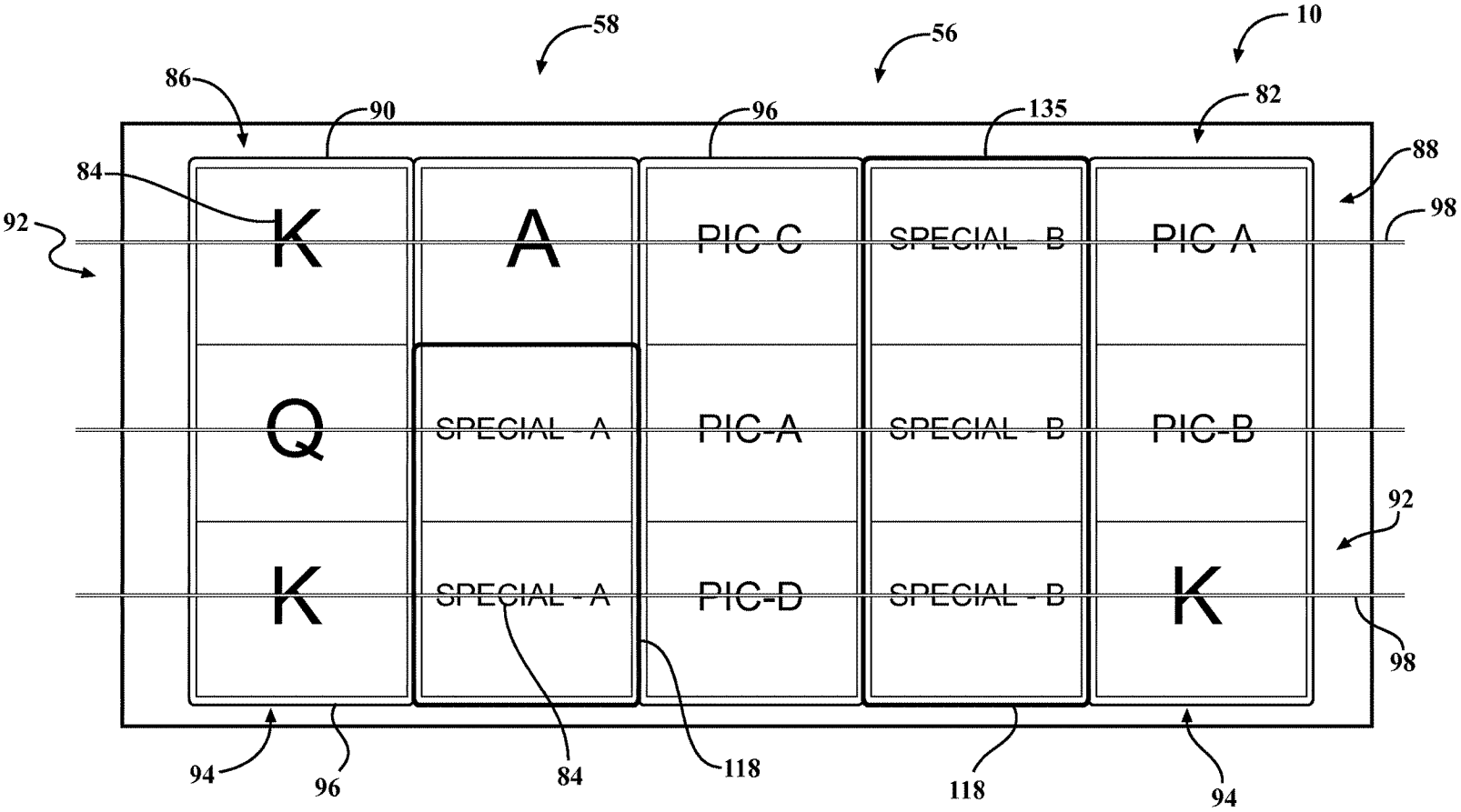
FIG. 3 is a graphical display of a slot game that may be displayed on the gaming device shown in FIG. 1, according to an embodiment of the present invention.
Figure 4:
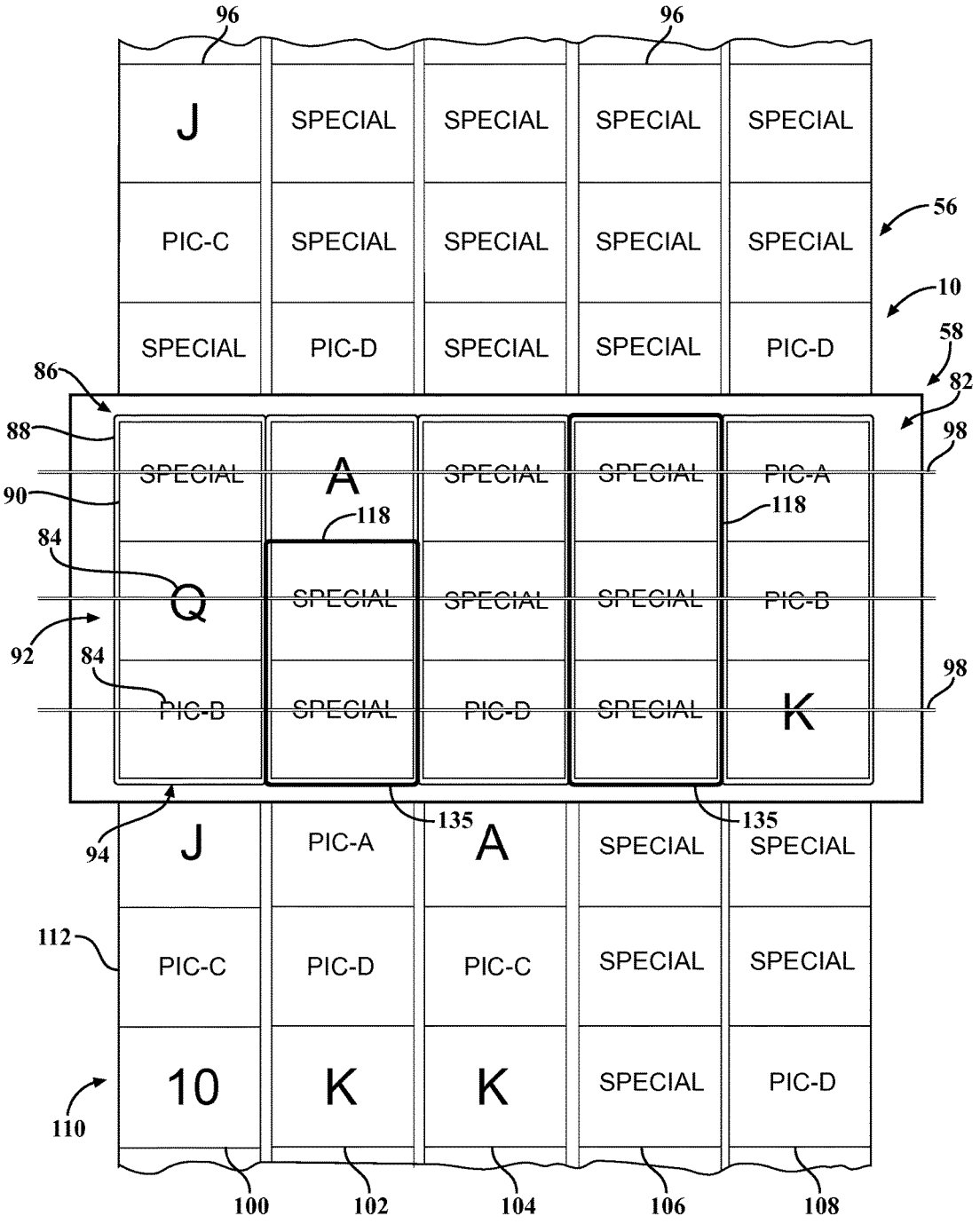
FIG. 4 is a schematic representation of a portion of the gaming device shown in FIG. 1 including the slot game shown in FIG. 3 illustrating a plurality of slot reels, according to an embodiment of the present invention.

FIG. 3 is an exemplary graphical display of a game 56 that is displayed by the gaming device 10. FIG. 4 is a schematic representation of a portion of the gaming device 10. In the illustrated embodiment, the gaming controller 16 is configured to display the game 56 on the display device 12. In one embodiment, the game 56 is a video slot game. However, it should be noted that the game 56 may be any type of game upon which a player could make a wager including, but not limited to a keno game, a blackjack game, a video poker game, or any type of game that enables the gaming controller 16 to function as described herein. In addition, in one embodiment, the game 56 may include a slot game being displayed with a plurality of mechanical reels (shown in FIGS. 9 and 10). In the illustrated embodiment, the game 56 is displayed on the first display 52. Alternatively, the game 56 may be displayed on the first display 52 and/or the second display 54.

In general, during play of the game 56, the gaming controller 16 randomly generates an outcome 82 of the game 56 and displays the generated game outcome 82 in the game screen 58. The gaming controller 16 randomly selects a plurality of game symbols 84 from a predefined set of possible game symbols and displays the selected game symbols 84 associated with the generated game outcome 82 in the game screen 58.

In the illustrated embodiment, the plurality of symbols 84 are displayed in display area 86 that includes a grid 88 having a plurality of cells 90 arranged along a plurality of rows 92 and a plurality of columns 94. Each cell 90 displays one or more game symbols 84 associated with the game outcome 82. In the illustrated embodiment, the gaming controller 16 displays the game symbols 84 within a plurality of reels 96. Each reel 96 is associated with a corresponding column 94. The game 56, in the illustrated embodiment, includes 5 reels 96 with 3 cells per reel, respectively (a "5×3" arrangement) displayed in the display area 86. Alternatively, other reel arrangements may be used such as, for example, 3-4-3-4-3, 4-5-5-5-4, or 4-5-4-5-4 arrangements or arrangements with the same number of cells per column, such as 3×3, 3×4, 4×5, or 5×5 configurations. The game 56 also includes a plurality of paylines 98 that extend across one or more cells 90 to indicate, to the player, a combination of game symbols 84. In one embodiment, the gaming device 10 may display the game 56 using a plurality of mechanical reels (shown in FIGS. 9 and 10) that include a plurality of symbols displayed on a circumferential surface of each reel.

Each slot game 56 is generally played in a conventional manner. The player makes a wager, which may be based on a predetermined denomination and a selected number of paylines 98, the gaming controller 16 randomly generates an outcome for the game 56, spins the reels 96, and selectively stops the reels 96 to display a game symbol 84 in each of the display cells 90. If a predetermined pattern of symbols 84 is randomly chosen for each cell 90 on a played payline 98, the player may be awarded a payout based on the payline, the wager, and a predetermined paytable. Moreover, the player may be awarded a payout if the combination of symbols 84 associated with a selected payline 98 is a winning combination. In addition, a player may receive a bonus feature and/or a bonus game based on the combination of symbols 84 associated with the selected payline 98 and/or the appearance of one or more predefined symbols 84 in the game outcome 82. Many variations to the above described general play of a slot game fall within the scope of the present invention. Such slot games are well-known in the art, and are therefore not further discussed.

In the illustrated embodiment, the gaming controller 16 receives a signal, from the user input device 14, that is indicative of a player's selection to initiate a gaming session including a wager amount, and a selection of one or more paylines 98 associated with a predefined set of cells 90 within the display area 86. In the illustrated embodiment, the game 56 is a multi-line game, i.e., the paylines include horizontal paylines and/or diagonal pay-lines, and/or zig-zag paylines. Moreover, the user input device 14 may allow the player to toggle to increase the bet per payline a credit at a time (up to the maximum bet). The gaming controller 16 randomly generates an outcome of the game 56, and displays the generated outcome 82 on the game screen 58. In one embodiment, the gaming controller 16 is configured to rotate, and/or spin each reel 96 to initiate a game play, and stop each reel 96 to display a plurality of symbols 84 associated with the randomly generated outcome 82. In addition, the gaming controller 16 is adapted to determine if the generated outcome 82 is a winning outcome as a function of the displayed game symbols 84, a pay-table, a wager, and one or more player selected paylines 98. More specifically, the gaming controller 16 determines if a combination of symbols 84 arranged along the selected payline 98 is a winning combination. The gaming controller 16 may provide an award in response to the outcome of the game 56. In general, the term "award" may be a payout, in terms of credits or money. Thus, the gaming controller 16 may award a regular payout in response to the outcome of the game 56. However, it should be noted that the term award may also refer to other types of awards, including, prizes, e.g., meals, show tickets, etc. . . . , as well as in-game award, such as free games or awarding the player one or more wild symbols or stacked wild symbols in each of the games.

The gaming controller 16 is configured to display the game 56 including a plurality of reels 96. For example, in one embodiment, the gaming controller 16 displays the game 56 having five reels 96 orientated horizontally and including a $1^{st}$ reel 100, a $2^{nd}$ reel 102, a $3^{rd}$ reel 104, a $4^{th}$ reel 106, and a $5^{th}$ reel 108. Each reel 96 includes one or more associated reel strips 110 (shown in FIGS. 6-8) that may be displayed on a respective reel 96. Each reel strip 110 includes a plurality of symbol positions 112 that each may have a game symbol 84 displayed therein. During display of the generated game outcome 82, the gaming controller 16 spins each reel 96 such that the game symbols 84 are moved through each of the cells 90 in the display area 86.

Figure 5:
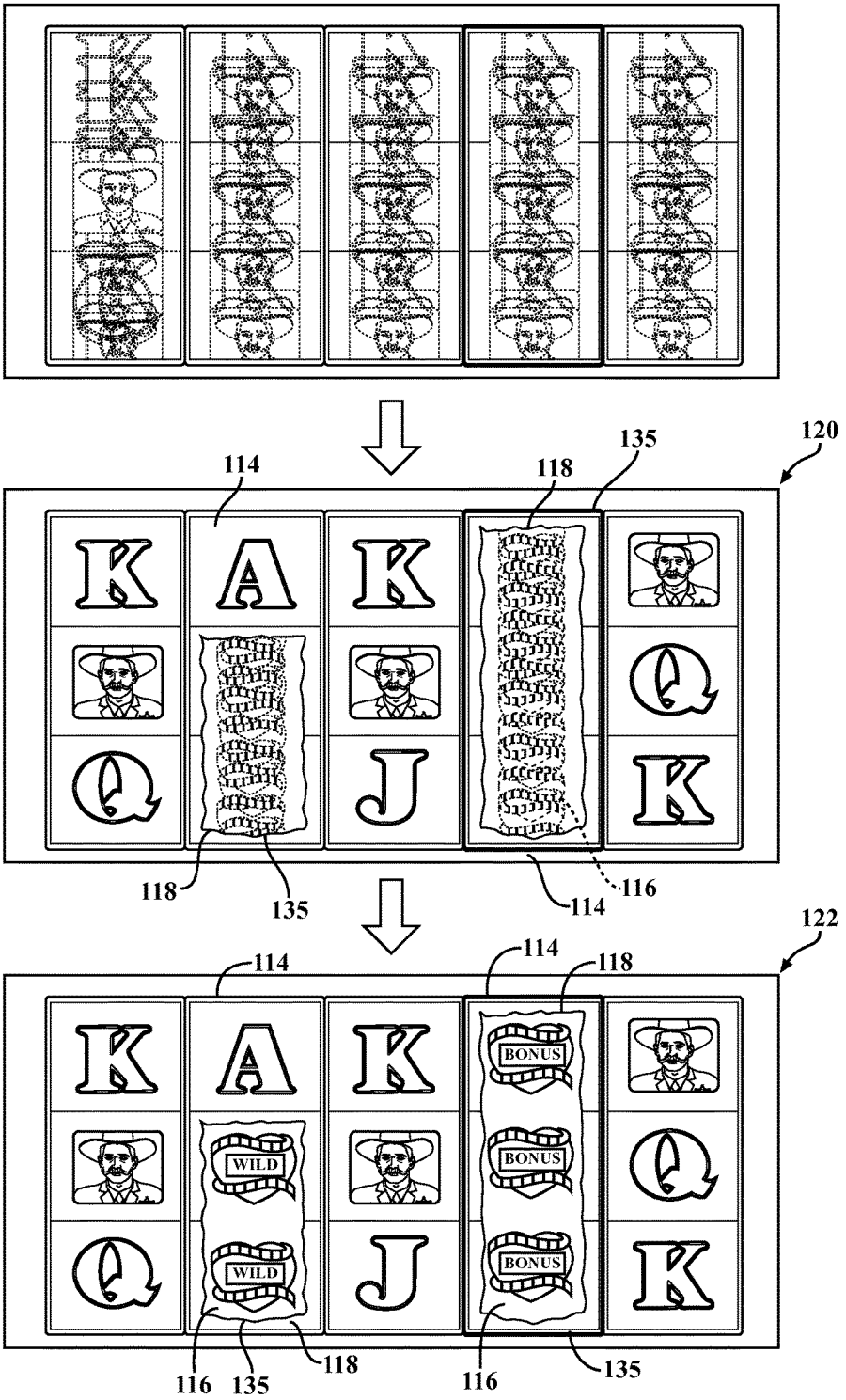
FIG. 5 is series of graphical displays of the slot game shown in FIG. 3, according to an embodiment of the present invention.
Figure 6:
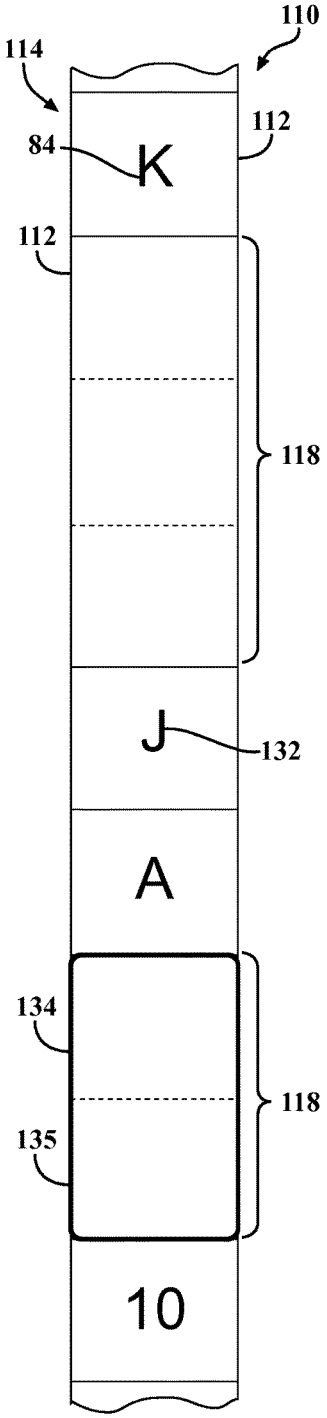
FIGS. 6-8 are schematic representations of reel strips that may be used with the slot reels shown in FIGS. 3-4, according to an embodiment of the present invention.
Figure 7:
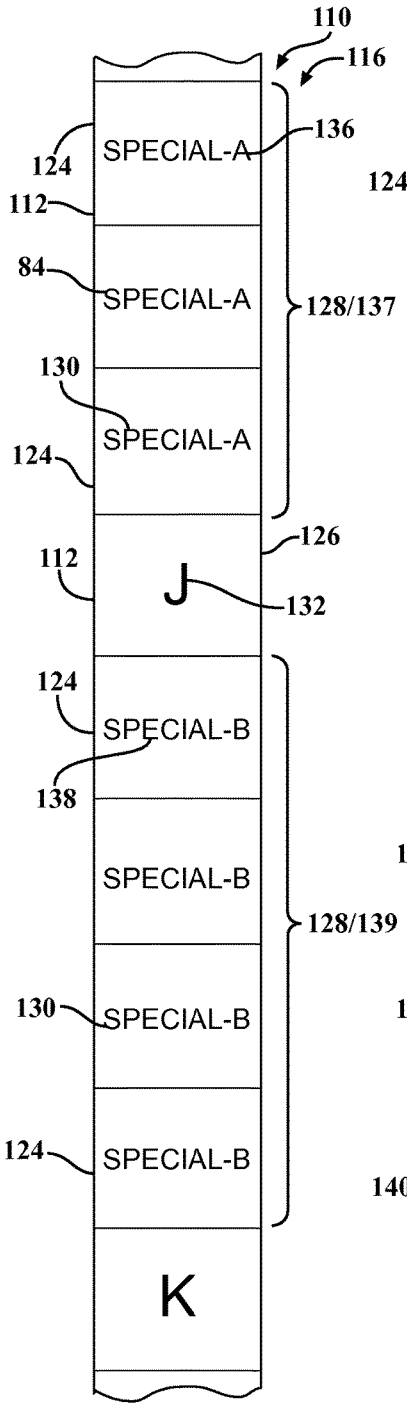

Referring to FIGS. 3-7, in the illustrated embodiment, at least one reel 96 such as, for example, the $2^{nd}$ reel 102 and the $4^{th}$ reel 106, include a primary reel strip 114 (shown in FIG. 6) and a secondary reel strip 116 (shown in FIG. 7). The primary reel strip 114 includes one or more symbol selection areas 118. Each symbol selection area 118 includes at least one symbol position 112. Each symbol position 112 within the symbol selection area 118 is adapted to display one or more symbols 84 that are selected from the secondary reel strip 116. For example, as shown in FIG. 5, in the illustrated embodiment, during operation, the gaming controller 16 generates and displays the $2^{nd}$ reel 102 with a primary reel strip 114 having at least one symbol selection area 118 being displayed on the $2^{nd}$ reel 102. The gaming controller 16 randomly generates an outcome of the game 56 that includes a first outcome 120, i.e. an intermediate outcome, and a second outcome 122, i.e. a final outcome. The first outcome 120 of the game 56 includes the symbols 84 being displayed in the primary reel strip 114 of the $2^{nd}$ reel 102. The gaming controller 16 spins and stops each of the reels 96 to display the first outcome 120 in the grid 88 and detects the appearance of the symbol selection area 118 being displayed in the grid 88. Upon detecting the symbol selection area 118 being displayed in the first outcome 120, the gaming controller 16 selects one or more symbols 84 from the secondary reel strip 116 and displays the selected symbols 84 within the symbol selection area 118 to display the second outcome 122 in the display grid 88. The gaming controller 16 also provides an award to the player as a function of the symbols 84 being displayed in the second outcome 122 including the symbols 84 displayed in the primary reel strip 114 and the symbols 84 selected from the secondary reel strip 116 and being displayed within the symbol selection area 118.

In the illustrated embodiment, the gaming controller 16 displays the $2^{nd}$ reel 102 such that the symbols 84 on the secondary reel strip 116 are displayed within the symbol selection area 118 and are viewable through the primary reel strip 114. For example, as shown in FIG. 5, during display of the first outcome 120, the gaming controller 16 spins the $2^{nd}$ reel 102 such that the primary reel strip 114 and the secondary reel strip 116 are each displayed as spinning. More specifically, as the symbol selection area 118 of the primary reel strip 114 is spun through the display grid 88, the spinning secondary reel strip 116 is also viewable through the symbol selection area 118. In addition, as the gaming controller 16 stops the $2^{nd}$ reel 102 to display the first outcome 120, the secondary reel strip 116 will remain spinning for a predefined period of time after each of the reels 96 has stopped to display the first outcome 120. More specifically, the spinning secondary reel strip 116 is viewable through the symbol selection area 118 with the primary reel strip 114 in a stopped position. After a predefined period of time, the gaming controller 16 stops the secondary reel strip 116 to display the selected symbols 84 within the symbol selection area 118 to display the second outcome 122 that includes the symbols 84 displayed on the primary reel strip 114 and the symbols displayed on the secondary reel strip 116.

Figure 8:
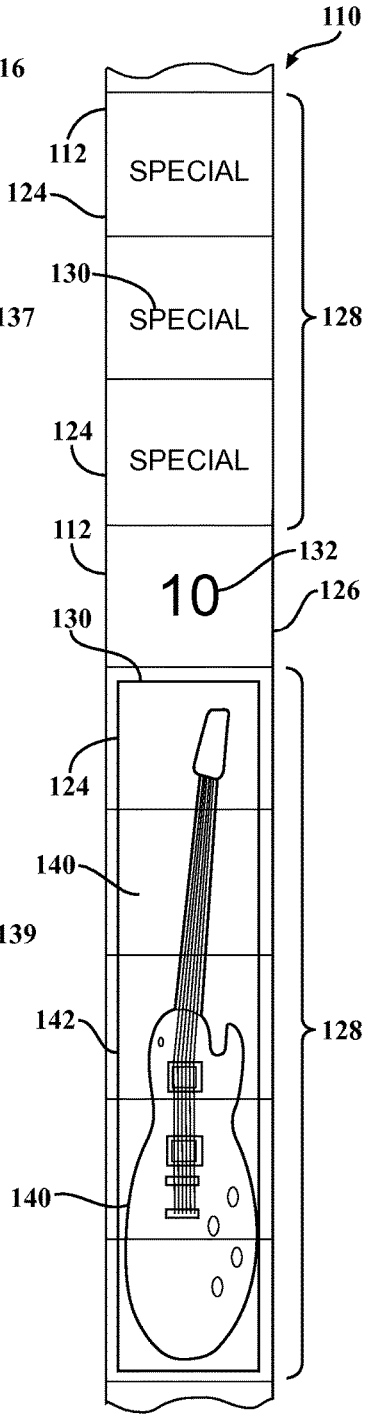

Referring to FIGS. 6-8, in one embodiment, each reel strip 110 may include a plurality of symbol positions 112 including a plurality of special symbol positions 124 (represented by the "special" mark shown in FIGS. 3-8) and a plurality of normal symbol positions 126. Moreover, the reel strip 110 may include at least one run 128 of consecutive special symbol positions 124 that include a plurality of adjacent special symbol positions 124. During a round of the game 56, the gaming controller 16 may randomly select at least one special symbol 130 from a predefined set of special symbols 130, and display the selected special symbol 130 in each special symbol position 124 of the run 128 of consecutive special symbol positions 124. In one embodiment, the gaming controller 16 may display the same special symbol 130 in each special symbol position 124 of the run 128 of consecutive special symbol position 124. Alternatively, the gaming controller 16 may select a plurality of similar special symbols 130 and/or a plurality of associated special symbols such as, for example, a set of special symbols included in a category of special symbols, for display in each special symbol position 124. For example, the predefined set of special symbols 130 may include, but is not limited to, a category of special symbols such as, for example, shapes, colors, sounds, items, characters, backgrounds, frames, and/or any category of special symbols that enable the gaming controller 16 to function as described herein. Each special symbol category includes a plurality of special symbols having predefined characteristics associated with the special symbol category. For example, the predefined set of special symbols 130 may include a shape category that includes a plurality of special symbols that each have a shape associated with the shape category. The gaming controller 16 may select one or more special symbols indicative of the shapes within the shape category, and display the selected special symbols in each of the special symbol positions 124.

In the illustrated embodiment, each reel strip 110 also includes a plurality of normal symbols 132 (represented by the "PIC-a", "PIC-b", "PIC-c", "PIC-d", "A", "K", "Q", "J", and "10" symbol marks shown in FIGS. 3-8) that are displayed in each normal symbol position 126. In the illustrated embodiment, the normal symbols 132 are static symbols wherein each normal symbol 132 appears in the associated normal symbol position 126 for each round of the game 56. Alternatively, the gaming controller 16 may randomly select a plurality of normal symbols 132 from a predefined set of normal symbols 132 for each game 56 such that each game 56 may include a different set of normal symbols 132 being displayed in each of the normal symbol positions 126. In addition, the predefined set of normal symbols 132 may include any game symbol not included in the predefined set of special symbols 130.

In the illustrated embodiment, each symbol selection area 118 includes a selection characteristic for use by the gaming controller 16 in selecting one or more symbols 84 to be displayed within the symbol selection area 118. In one embodiment, the symbol selection area 118 may be displayed with a symbol image 134 that is indicative of the symbol selection area 118. The symbol image 134 may be displayed with a plurality of selection characteristics such as, for example, a design, a shape, a color, an appearance, an opacity, a transparency, and/or any suitable characteristics that may be used to indicate the symbol selection area 118 to the player. In addition, a selection characteristic may also include a number of symbol positions 112 being displayed in the symbol selection area 118. In the illustrated embodiment, the gaming controller 16 determines the selection characteristic being displayed with the symbol selection area 118 and responsively selects a symbol 84 to be displayed in the symbol selection area 118 based on the determined selection characteristic. More specifically, the gaming controller 16 determines the selection characteristic being displayed with the symbol selection area 118 in the first outcome 120 and compares the determined selection characteristic with the list of selection characteristics contained in the selection table 80 stored in the database 78. The gaming controller 16 selects the symbol 84 associated with the determined selection characteristic listed the selection table 80 and displays the selected symbol 84 in the symbol selection area 118 to display the second outcome 122.

For example, in the illustrated embodiment, the symbol selection area 118 is displayed with a frame 135 that extends across a perimeter of the symbol positions 112 being displayed within the symbol selection area 118. In addition, the frame 135 may be displayed with one of a plurality of frame colors that are indicative of the selection characteristic of the corresponding symbol selection area 118. During operation, the gaming controller 16 determines the color of the frame 135 that is being displayed with symbol selection area 118 displayed in the first outcome 120, and selects a symbol 84 from the secondary reel strip 116 based on the determined frame color. More specifically, the gaming controller 16 compares the determined frame color with a list of frame colors contained in the selection table 80 and selects the symbol 84 corresponding to the determined frame color. In addition, in one embodiment, the gaming controller 16 may determine a number of symbol positions 112 being displayed within the frame 135, compare the determined number of symbol positions 112 with a corresponding number of symbol positions contained in the selection table 80, and select the symbol 84 that corresponds to the determined number of symbol positions 112 being displayed within the frame 135.

In one embodiment, the gaming controller 16 may randomly select a symbol 84 being displayed in the symbol selection area 118 as a function of the determined selection characteristic of the symbol selection area 118. Moreover, the selection table 80 may include a predefined set of symbols 84 that each includes an associated symbol selection probability associated with each selection characteristic. During operation, the gaming controller 16 may determine the selection characteristic being displayed with the symbol selection area 118, determine a selection probability of each symbol 84 in the predefined set of symbols 84 as a function of the determined selection characteristic, and randomly select one or more symbols 84 being displayed in the symbol selection area 118 as a function of each corresponding symbol selection probability. For example, the probability of selecting a symbol 84 determined as a function of a selection characteristic may be provided as in the following chart. The selection characteristics listed in the following chart is for illustrative purposes only and do not limit the scope of the invention as described herein.

| | Selection Characteristic | |
|---|---|---|
| Symbol | GREEN Frame Color | RED Frame Color |
| PIC - a | 40% | 40% |
| PIC - b | 20% | 10% |
| K | 40% | 50% |

The first column represents a plurality of symbols 84 from a predefined set of symbols 84 that may be included in the secondary reel strip 116. The second column represents the probability of selecting each symbol 84 (PIC-a, PIC-b, "K") associated with a "GREEN" frame color selection characteristic associated with the symbol selection area 118. The second column represents the probability of selecting each symbol 84 (PIC-a, PIC-b, "K") associated with a "RED" frame color selection characteristic associated with the symbol selection area 118.

In the illustrated embodiment, the gaming controller 16 determines the color being displayed with the frame 135 associated with the symbol selection area 118 being displayed in the display grid 88 with the first outcome 120, determines the probability of selection for each symbol 84 based on the determined frame color being displayed in the first outcome 120, selects one or more symbols 84 based on the determined probabilities, and displays the selected symbols 84 in the symbol positions 112 included in the symbol selection area 118 to display the second outcome 122. For example, if the gaming controller 16 determines the frame 135 is being displayed with a "GREEN" frame color, the gaming controller 16 may determine the selection probabilities associated with the PIC-a symbol, the PIC-b symbol, and the "K" symbol to be 40%, 20%, and 40%, respectively, and select one or more of the symbols 84 as a function of the corresponding selection probabilities. Similarly, if the gaming controller 16 determines the frame color to be "RED", the gaming controller 16 may determine the selection probabilities associated with the PIC-a symbol, the PIC-b symbol, and the "K" symbol to be 40%, 10%, and 50%, respectively, and select one or more of the symbols 84 as a function of the corresponding selection probabilities. In one embodiment, each symbol 84 may include a different selection probability associated with each selection characteristic.

In one embodiment, the gaming controller 16 may determine a number of symbol positions 112 being displayed in the symbol selection area 118, and select a different symbol 84 to be displayed in each symbol position 112. In another embodiment, the gaming controller 16 may select the same symbol 84 to be displayed in each symbol position 112 being displayed with the symbol selection area 118.

In addition, the gaming controller 16 may select an appearance of the selected symbol 84 as a function of the determined selection characteristic. For example, if the selection characteristic is an appearance of the symbol selection area 118, the gaming device 10 may display the selected symbols 84 with an appearance that is indicative of the appearance of the symbol selection area 118. For example, during operation, the gaming controller 16 may determine the selection characteristic to be a "GREEN" frame color, select a symbol 84 as a function of the selection characteristic and the corresponding selection probabilities, and display the selected symbol 84 with an appearance such as, for example, a green hue or green highlights that is indicative of the "GREEN" frame color.

FIGS. 7 and 8 are schematic representations of secondary reel strips 116 that may be used with a slot reel 96. Referring to FIG. 7, in the illustrated embodiment, the secondary reel strip 116 includes a plurality of special symbol positions 124, a plurality of normal symbol positions 126, and at least one run 128 of consecutive special symbol positions 124 that include a plurality of adjacent special symbol positions 124. Each normal symbol position 126 includes a static normal symbol 132. During operation, the gaming controller 16 may select a symbol 84 to be displayed in each of the special symbol positions 124 included in the run 128 of consecutive special symbol positions 124 as a function of selection probabilities included in the symbol selection table 80. Moreover, during display of the second outcome 122, the gaming controller 16 may spin the secondary reel strip 116 such that the run 128 of consecutive special symbol positions 124 is viewable to the player to increase the player's anticipation of a winning outcome.

In addition, the gaming controller 16 may randomly select at least one special symbol 130 from the predefined set of special symbols 130, and display the selected special symbol 130 in each special symbol position 124 in the secondary reel strip 116 for use in displaying the second outcome 122. Additional details of adjacent special symbol positions, which may be used in the present invention, are described in U.S. patent application Ser. No. 11/299,009 to Yoshimi, now U.S. Pat. No. 8,096,869, filed Dec. 9, 2005, titled "Gaming device with Runs of Consecutive Identical Symbols", which is incorporated herein by reference in its entirety.

In one embodiment, the secondary reel strip 116 may include a plurality of runs 128 of consecutive special symbol positions 124. For example, in one embodiment, the secondary reel strip 116 may include at least two runs 128 of consecutive special symbol positions 124. During game play, the gaming controller 16 randomly selects a special symbol 130 and displays the selected special symbol 130 in each special symbol position 124 of the runs 128 of consecutive special symbol positions 124. Moreover, the secondary reel strip 116 may include at least one normal symbol position 126 displayed between the runs 128 of consecutive special symbol positions 124.

In one embodiment, the gaming controller 16 may randomly select a different special symbol 130 to be displayed in each of the runs 128 of consecutive special symbol positions 124 and display a corresponding selected special symbol 130 in each special symbol position 124 of the associated run 128 of consecutive special symbol positions 124. For example, in one embodiment, the gaming controller 16 may select a first special symbol 136 (e.g. "Special-A") to be displayed in a first run 137 of consecutive special symbol positions 124, and select a second special symbol 138 (e.g. "Special-B") to be displayed in a second run 139 of consecutive special symbol positions 124. In one embodiment, the first special symbol 136 and the second special symbol 138 are different. In another embodiment, the first special symbol 136 and the second special symbol 138 are similar. Moreover, the first and second special symbols 136 and 138 may be the same special symbol. In addition, the first and second special symbols 136 and 138 may be selected from the same category of special symbols and/or be selected from different categories of special symbols.

Referring to FIG. 8, in one embodiment, the gaming controller 16 may display a special symbol 130 having a plurality of symbol images 140 such that a plurality of adjacent special symbols 130 are displayed as a unitary image 142 that extends across a run 128 of consecutive special symbol positions 124. For example, the gaming controller 16 may randomly select a special symbol 130 to be displayed in each special symbol position 124 of a run 128 of consecutive special symbol positions 124, wherein the selected special symbol 130 includes a plurality of symbol images 140. Each selected special symbol 130 is displayed in each of the adjacent special symbol positions 124 with a different symbol image 140 such that a unitary symbol image 142 extends across each adjacent special symbol position 124.

In another embodiment, the gaming controller 16 may select a plurality of special symbols 130 from the same category of special symbols, wherein each selected special symbol 130 forms a portion of the unitary symbol image 142 such that when the selected special symbols 130 are displayed in each adjacent special symbol position 124 of a run 128 of consecutive special symbol positions 124, the unitary symbol image 142 is displayed across the adjacent special symbol positions 124.

Figure 9:
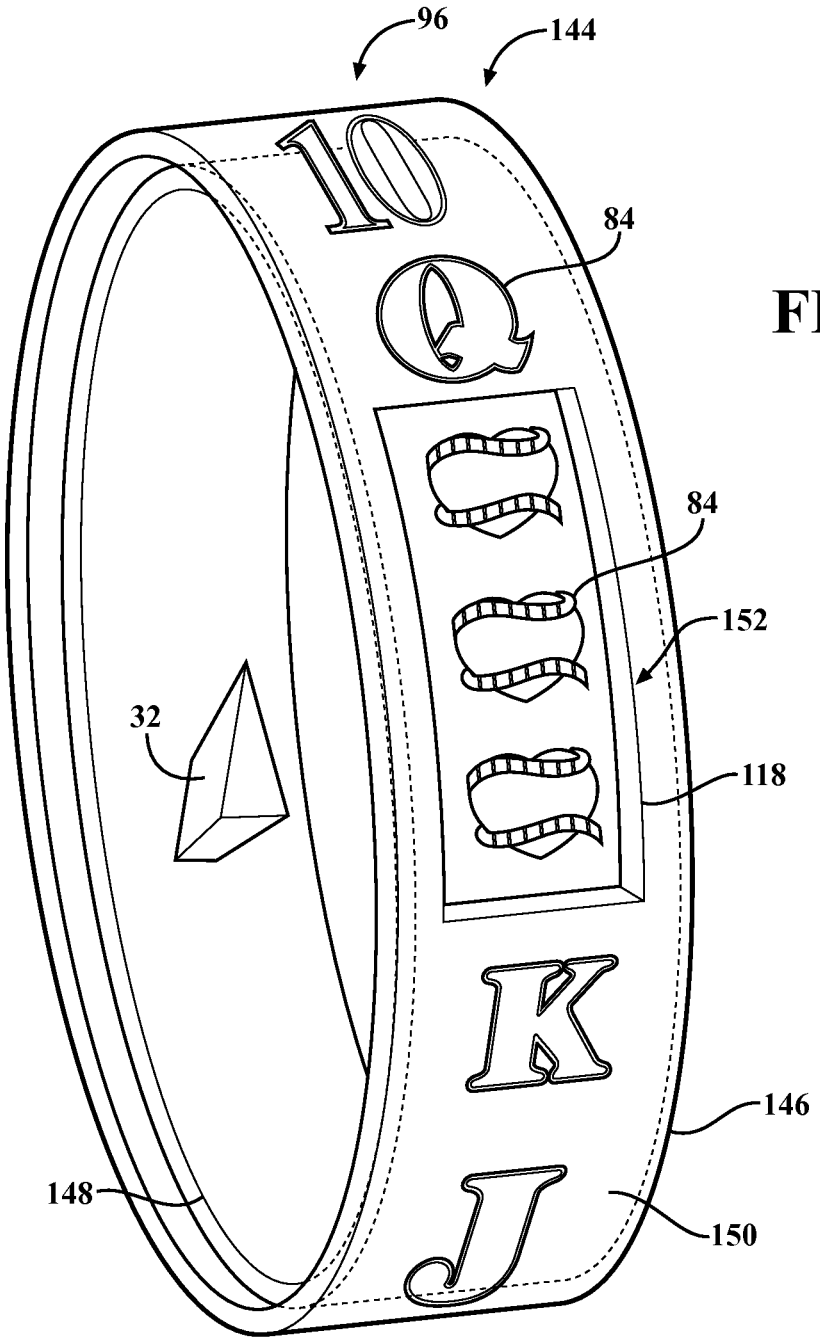
FIG. 9 is a perspective view of a reel set that may be used with the gaming device shown in FIGS. 1-4, according to an embodiment of the present invention.
Figure 10:
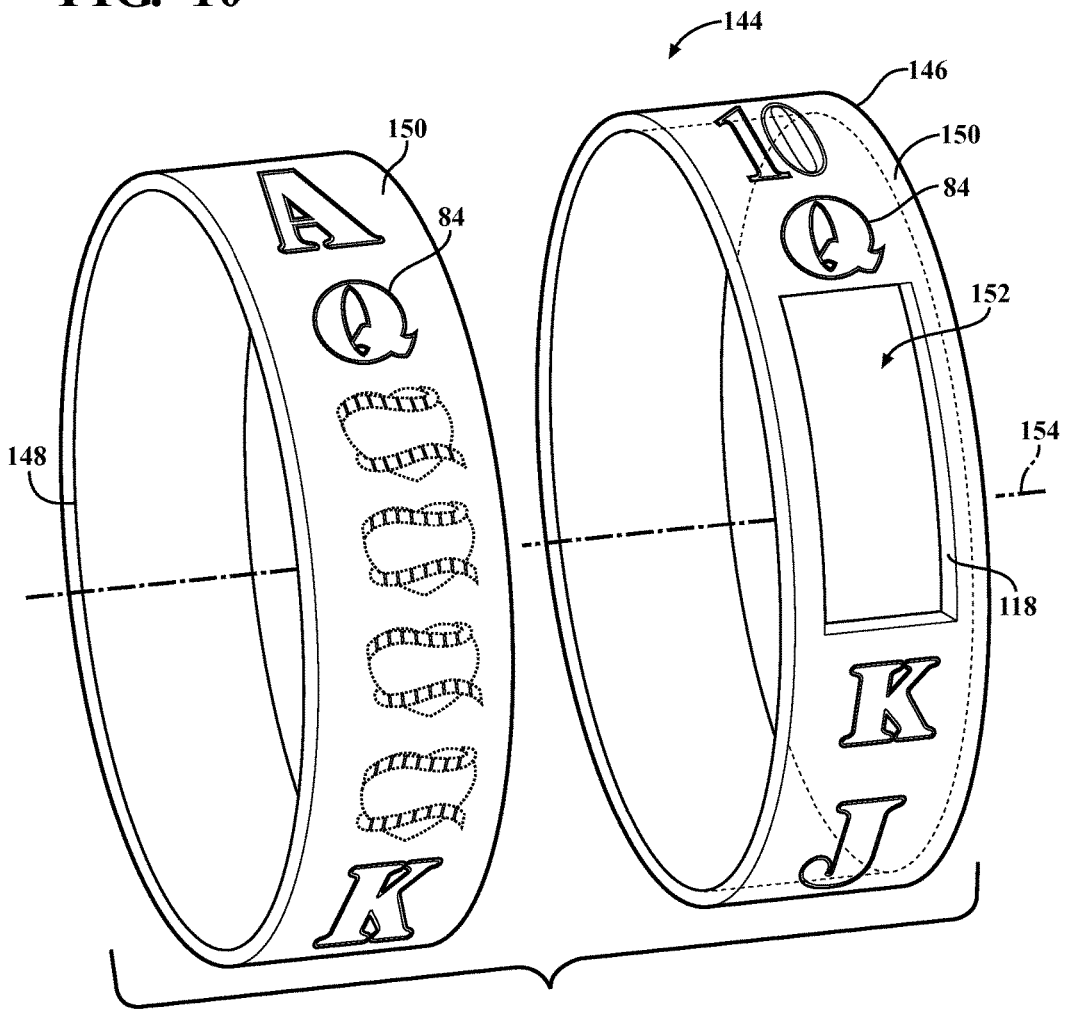
FIG. 10 is an exploded perspective view of the reel set shown in FIG. 9.

FIG. 9 is a perspective view of a reel set 144 that may be used with the gaming device 10, according to an embodiment of the present invention. FIG. 10 is an exploded perspective view of the reel set 144. In one embodiment, the gaming device 10 includes a plurality of mechanical reels 96. At least one reel 96 such as, for example, the $2^{nd}$ reel 102 includes a reel set 144 that includes an outer reel 146 and an inner reel 148. The outer reel 146 and the inner reel 148 each include a circumferential outer surface 150 that displays a plurality of symbols 84 thereon. In the illustrated embodiment, the outer reel 146 is displayed with the primary reel strip 114 including at least one symbol selection area 118. The symbol selection area 118 includes a viewable area 152 that is sized and shaped to enable the inner reel 148 to be viewable through the symbol selection area 118. The inner reel 148 is displayed with the secondary reel strip 116 and is positioned within the outer reel 146 such that the secondary reel strip 116 is viewable through the viewable area 152 of the outer reel symbol selection area 118.

In the illustrated embodiment, the inner reel 148 is positioned within the outer reel 146 and is orientated concentrically with respect to the outer reel 146 such that the outer and inner reels 146 and 148 are each orientated about a common centerline axis 154. Alternatively, the inner reel 148 may be offset a distance from the centerline axis 154 such that the inner and outer reel 146 are not concentrically aligned and the inner reel 148 is centered about a different centerline axis (not shown).

In the illustrated embodiment, the gaming device 10 also includes a lighting device 32 that is orientated with respect to the outer and inner reels 146 and 148 to selectively illuminate the symbols 84 being displayed in the inner reel 148. More specifically, the gaming device 10 may operate the lighting device 32 to backlight the symbols 84 displayed on the inner reel 148 to modify the symbol type, shape, color, or illumination of the symbols 84 being displayed on the inner reel 148 and viewable through the symbol selection area 118 of the outer reel 146. In addition, the gaming controller 16 may operate the lighting device 32 to display the symbols 84 in the symbol selection area 118 with an appearance determined as a function of a selection characteristic of the symbol selection area 118. For example, in one embodiment, the symbol selection area 118 may be displayed with a frame having a "GREEN" frame color. The gaming device 10 may operate the lighting device 32 to display the inner reel symbols 84 having a corresponding "GREEN" symbol color. In addition, the gaming device 10 may operate the lighting device 32 to modify the appearance of the symbols 84 being displayed in the symbol selection area 118 to match an appearance characteristic of the symbol selection area 118. Many variations to the above described lighting device 32 and the operation of the illumination device to modify a symbol appearance fall within the scope of the present invention. Such backlit illumination devices are well-known in the art, and are therefore not further discussed.

Referring to FIG. 5, in one embodiment, the gaming device 10 includes a plurality of reels 96. In addition, the $2^{nd}$ reel 102 and the $4^{th}$ reel 106 each include a reel set 144 including an inner reel 148 and an outer reel 146. During operation, the gaming controller 16 randomly generates an outcome of the game 56 and spins each of the reels 96 including each of the inner reels 148 and the outer reels 146. The gaming controller 16 then stops each outer reel 146 to display the first outcome 120, while the inner reels 148 remain spinning. The gaming controller 16 detects the appearance of each symbol selection area 118 being displayed with the first outcome 120 and selects a symbol 84 to be displayed in the corresponding symbol selection areas 118. After a predefined period of time, the gaming device 10 stops each corresponding inner reel 148 to display the selected symbols 84 in the associated symbol selection areas 118 to display the second outcome 122. The gaming device 10 then provides an award to the player based on the symbols 84 displayed with the first outcome 120 and the second outcome 122.

Figure 11:
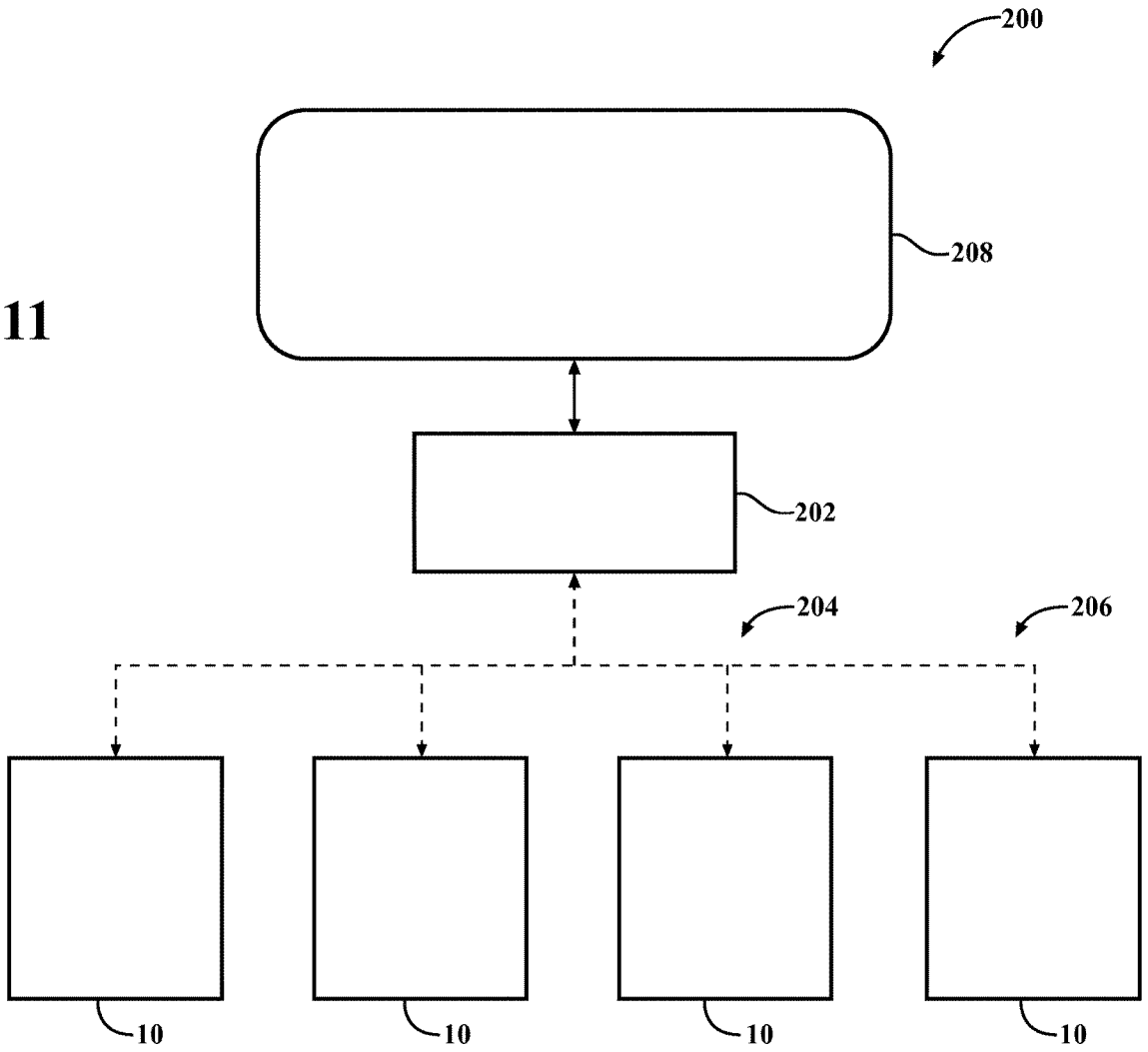
FIG. 11 is a schematic view of an exemplary gaming system of the present invention.

FIG. 11 is a schematic view of an exemplary gaming system 200. The gaming system 200 includes a system controller 202 and one or more gaming devices 10 that are coupled to the system controller 202. In one embodiment, the gaming device 10 may include a gaming machine installed in a casino. In another embodiment, the gaming device 10 may include a personal computer, laptop, cell phone, smartphone, tablet computer, personal data assistant, and/or any suitable computing device that enables a player to connect to the system controller 202 to play the game 56.

In the illustrated embodiment, the system controller 202 is configured to perform all of the functions of the gaming controller 16 as described herein. The system controller 202 communicates with each gaming device 10 for playing the game 56 on each gaming device 10 based on user selection input received from each gaming device 10. In the illustrated embodiment, the system controller 202 plays a separate instance of the game 56 on each gaming device 10 such that each player associated with the gaming devices 10 may play a separate instance of the game 56 simultaneously.

In the illustrated embodiment, the gaming devices 10 and the system controller 202 are coupled in communication with a local area network (LAN) 204. Alternatively, the gaming devices 10 and the system controller 202 may be coupled via a network such as, for example, an Internet link, an intranet, a WAN, dial-in-connections, cable modems, wireless modems, and/or ISDN lines. In the illustrated embodiment, the gaming system 200 includes four gaming devices 10, which in one embodiment as shown in FIG. 11 are arranged in a bank 206, i.e., are arranged together, adjacently. It should be noted, however, that the gaming system 200 may include any number of gaming devices 10 that may be arranged in any manner, such as in a circle or along a curved arc, or positioned within separate areas of a casino floor, and/or separate gaming establishments such as different casinos. Furthermore, additional groups of gaming devices 10 may be coupled to the system controller 202. In addition, in the illustrated embodiment, the gaming system 200 may also include a central display 208 that is coupled to the system controller 202 for displaying games played on one or more of the gaming devices 10.

In one embodiment, the system controller 202 may be implemented by one of the gaming controllers 16 associated with a gaming device 10. In still another embodiment, the system controller 202 may be located remotely with respect to the gaming devices 10, or within one of the gaming device cabinet assemblies 18 (shown in FIG. 1).

In one embodiment, the system controller 202 may also determine if a bonus triggering event occurs in a game outcome being played at one or more of the gaming devices 10, and displays a bonus game such as, for example, the game 56 on the central display 208 if the bonus triggering event occurs. Alternatively, the system controller 202 may display the game 56 at one or more gaming devices 10 based on one or more bonus triggering events occurring in games played at the gaming devices 10. The bonus triggering event may be the appearance of a predefined symbol and/or a predefined symbol combination in a game outcome.

Figure 12:
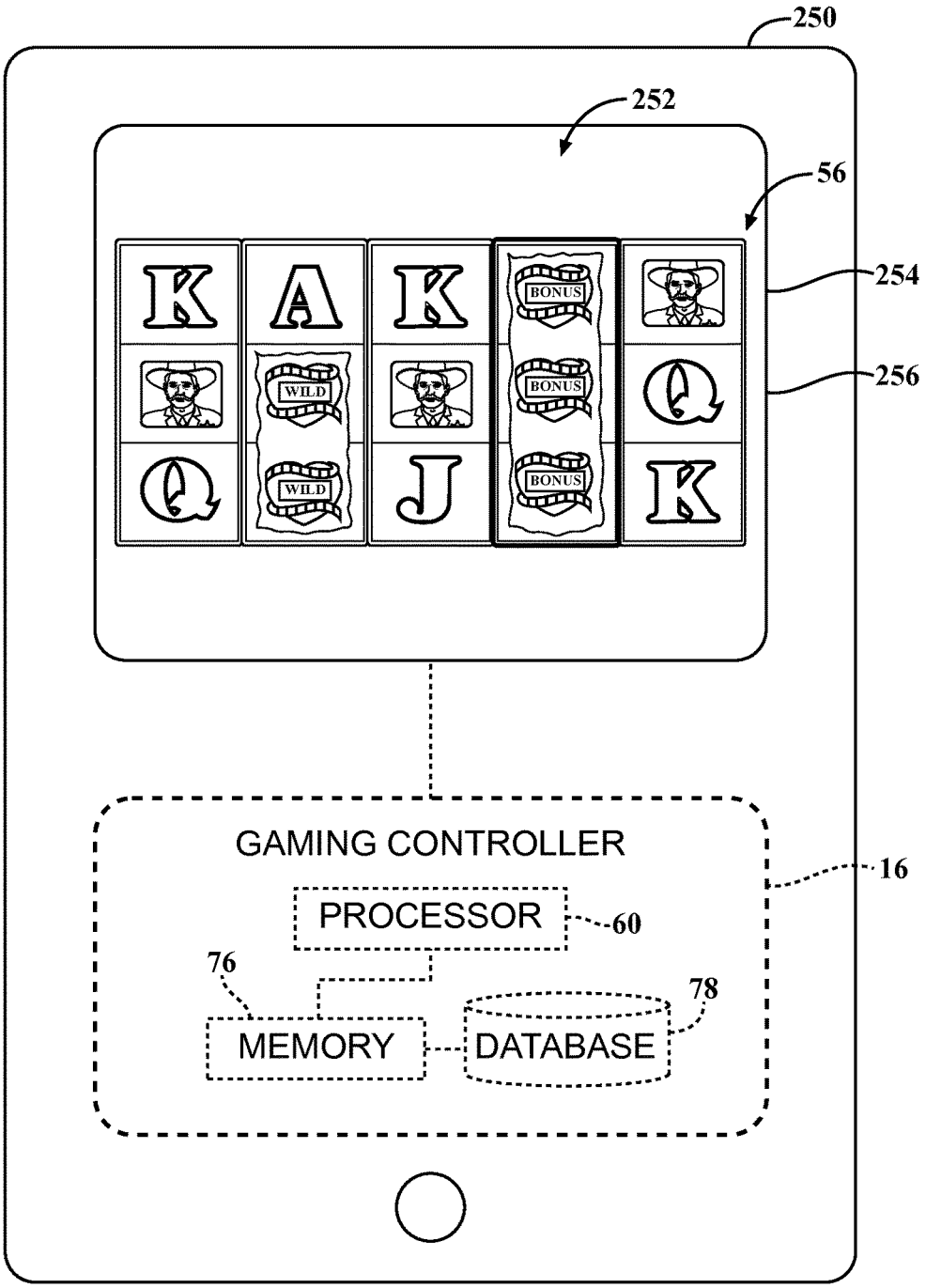
FIG. 12 is a schematic view of another gaming device that may be used to display the slot game shown in FIGS. 3-5.

FIG. 12 is a schematic view of another gaming device 250 for allowing a player to play the game 56, according to an embodiment of the invention. In the illustrated embodiment, the gaming device 250 may be a smartphone, a personal computer, laptop, cell phone, tablet computer, smartphone/tablet computer hybrid, personal data assistant, and/or any suitable computing device that displays graphical interfaces 252 that enable the user to play the game 56. In the illustrated embodiment, the gaming device 250 includes a display device 254 such as, for example, the display device 12, a user input device 256 such as, for example, user input device 14, and the gaming controller 16 coupled to the display device 12 and the user input device 14.

The gaming controller 16 includes the processor 60 and the memory device 76 that is coupled to the processor 60. The memory device 76 stores programs and information used by the processor 60 including, but not limited to, image data for producing images and/or screens on the display device 254, game indicia, symbol weights, paytables, and/or winning combination tables which represent relationships between combinations of random numbers, combinations of symbol matches and types of awards associated with the game 56

The processor 60 includes a computer readable medium, such as, without limitation, random access memory (RAM), read-only memory (ROM), erasable programmable read-only memory (EPROM), flash memory, a hard disk drive, a solid state drive, a diskette, a flash drive, a compact disc, a digital video disc, and/or any suitable device that enables the gaming controller 16 to store, retrieve, and/or execute instructions and/or data. The gaming controller 16 in particular executes a game program to implement the method 300 and thereby conducts the game 56 in accordance with the embodiments described herein.

Figure 13:
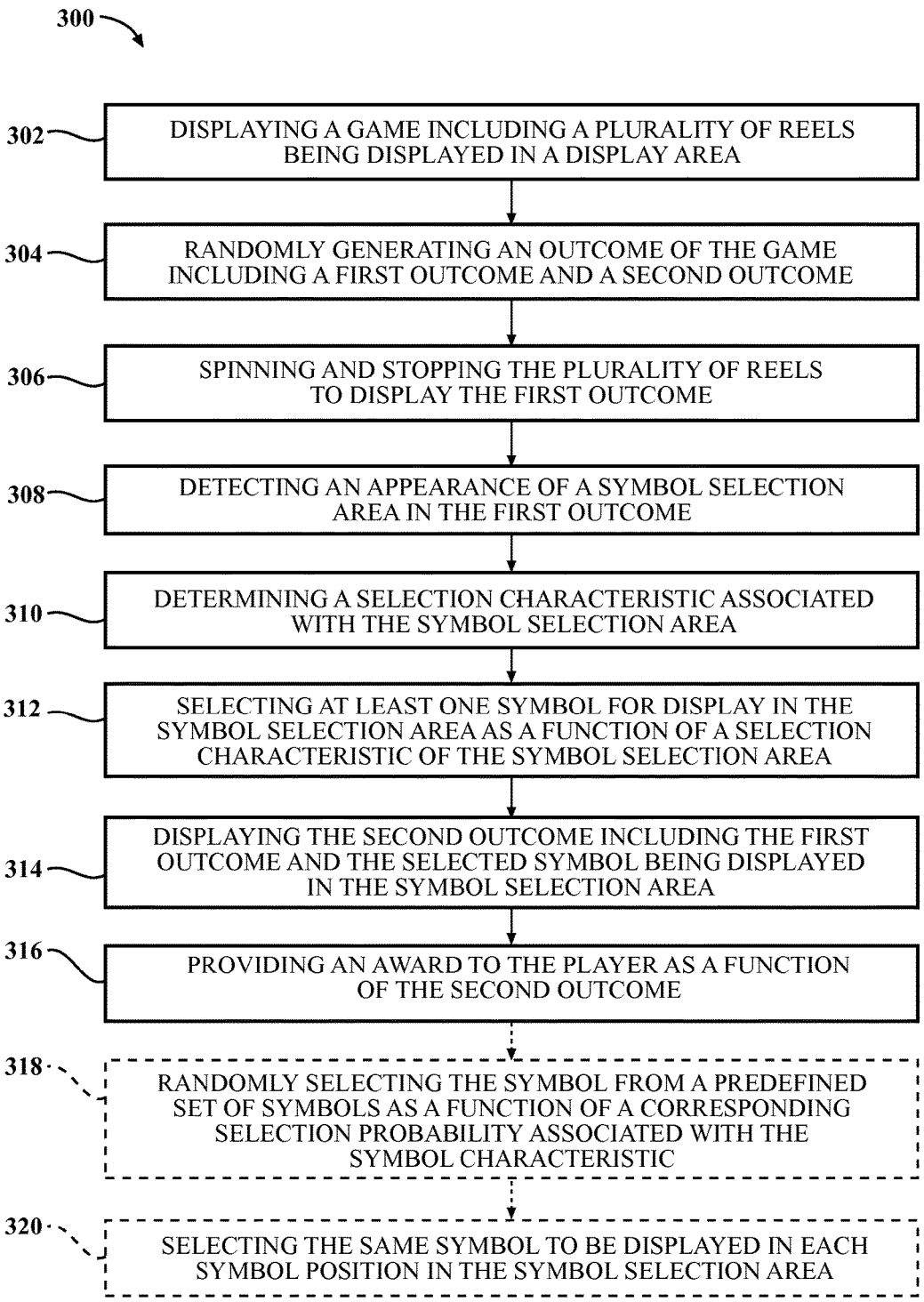
FIG. 13 is a flowchart of an exemplary method of allowing a player to play a gaming device, according to an embodiment of the present invention.

FIG. 13 is a flowchart of an exemplary method 300 of allowing a player to play a slot game with the gaming device 10. Each method step may be performed independently of, or in combination with, other method steps. Portions of the method 300 may be performed by any one of, or any combination of, the components of the system 200 and/or gaming device 10. In the illustrated embodiment, the method 300 includes displaying 302 a game including a plurality of reels being displayed in a display area 86, randomly generating 304 an outcome of the game that includes a first outcome and a second outcome, and spinning 306 and stopping the plurality of reels to display the first outcome. The method 300 also includes detecting 308 an appearance of a symbol selection area 118 in the first outcome 120, determining 310 a selection characteristic associated with the symbol selection area 118, randomly selecting 312 at least one symbol for display in the symbol selection area 118 as a function of a selection characteristic of the symbol selection area 118, displaying 314 the second outcome including the first outcome and the selected symbol 84 being displayed in the symbol selection area 118, and providing 316 an award to the player as a function of the second outcome.

In one embodiment, the method 300 may include the step of randomly selecting 318 the symbol from a predefined set of symbols, wherein each symbol in the predefined set of symbols has a corresponding selection probability associated with the symbol characteristic. In addition, the method 300 may also include the step of selecting 320 the same symbol to be displayed in each symbol position in the symbol selection area.

The above-described system, apparatus, and methods overcome at least some disadvantages of known gaming devices by providing a gaming device that displays a slot game that includes a reel having a symbol selection area that randomly displays additional symbols in the reel. More specifically, the gaming device displays a game that includes a reel that has a primary reel strip including a symbol selection area and a secondary reel strip. The gaming device randomly generates an outcome of the game and spins and stops the reel to display an intermediate outcome that shows a portion of the final game outcome. The gaming device detects the appearance of the symbol selection area in the intermediate outcome and selects a symbol from the secondary reel strip to be displayed within the symbol selection area. The gaming device then displays the final game outcome including the selected symbols being displayed in the symbol selection area. By providing a gaming device that displays an intermediate outcome, the player's expectation for achieving a win is increased and the enjoyment of the game is improved. Moreover, the player can anticipate a potential winning combination as combination of symbols are displayed in the intermediate game outcome. Thus, the amount of time that the game is played by patrons of a gaming establishment is thereby increased.

Exemplary embodiments of a gaming device, a gaming system, and a method of allowing a player to play a gaming device are described above in detail. The gaming device, system, and method are not limited to the specific embodiments described herein, but rather, components of the gaming device and/or system and/or steps of the method may be utilized independently and separately from other components and/or steps described herein. For example, the gaming device may also be used in combination with other gaming systems and methods, and is not limited to practice with only the gaming device as described herein. Rather, an exemplary embodiment can be implemented and utilized in connection with many other gaming system applications.

A controller, computing device, or computer, such as described herein, includes at least one or more processors or processing units and a system memory. The controller typically also includes at least some form of computer readable media. By way of example and not limitation, computer readable media may include computer storage media and communication media. Computer storage media may include volatile and nonvolatile, removable and non-removable media implemented in any method or technology that enables storage of information, such as computer readable instructions, data structures, program modules, or other data. Communication media typically embody computer readable instructions, data structures, program modules, or other data in a modulated data signal such as a carrier wave or other transport mechanism and include any information delivery media. Those skilled in the art should be familiar with the modulated data signal, which has one or more of its characteristics set or changed in such a manner as to encode information in the signal. Combinations of any of the above are also included within the scope of computer readable media.

The order of execution or performance of the operations in the embodiments of the invention illustrated and described herein is not essential, unless otherwise specified. That is, the operations described herein may be performed in any order, unless otherwise specified, and embodiments of the invention may include additional or fewer operations than those disclosed herein. For example, it is contemplated that executing or performing a particular operation before, contemporaneously with, or after another operation is within the scope of aspects of the invention.

In some embodiments, a processor, as described herein, includes any programmable system including systems and microcontrollers, reduced instruction set circuits (RISC), application specific integrated circuits (ASIC), programmable logic circuits (PLC), and any other circuit or processor capable of executing the functions described herein. The above examples are exemplary only, and thus are not intended to limit in any way the definition and/or meaning of the term processor.

In some embodiments, a database, as described herein, includes any collection of data including hierarchical databases, relational databases, flat file databases, object-relational databases, object oriented databases, and any other structured collection of records or data that is stored in a computer system. The above examples are exemplary only, and thus are not intended to limit in any way the definition and/or meaning of the term database. Examples of databases include, but are not limited to only including, Oracle® Database, MySQL, IBM® DB2, Microsoft® SQL Server, Sybase®, and PostgreSQL. However, any database may be used that enables the systems and methods described herein. (Oracle is a registered trademark of Oracle Corporation, Redwood Shores, Calif.; IBM is a registered trademark of International Business Machines Corporation, Armonk, N.Y.; Microsoft is a registered trademark of Microsoft Corporation, Redmond, Wash.; and Sybase is a registered trademark of Sybase, Dublin, Calif.)

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Other aspects and features of the present invention can be obtained from a study of the drawings, the disclosure, and the appended claims. The invention may be practiced otherwise than as specifically described within the scope of the appended claims. It should also be noted, that the steps and/or functions listed within the appended claims, notwithstanding the order of which steps and/or functions are listed therein, are not limited to any specific order of operation.

Although specific features of various embodiments of the invention may be shown in some drawings and not in others, this is for convenience only. In accordance with the principles of the invention, any feature of a drawing may be referenced and/or claimed in combination with any feature of any other drawing.

What is claimed is:

1. A method of allowing a player to play a slot game with a gaming device, comprising the steps of:

displaying, on a display device, a game including a plurality of reels being displayed in a display area, each reel of the plurality of reels including a reel strip including a plurality of symbols positions, at least one reel including a reel strip having at least one symbol selection area, the at least one symbol selection area including a plurality of adjacent symbol positions;

allowing a player, through an input device which accepts physical media indicating a monetary value, to make a wager on the game;

adjusting, by the controller, a credit balance associated with the player as a function of an amount of the wager;

randomly generating, by the controller, an outcome of the game, the outcome including a first outcome and a second outcome;

spinning and stopping the plurality of reels, by the controller, to display the first outcome;

detecting, by the controller, an appearance of a symbol selection area in the first outcome;

determining, by the controller, a selection characteristic associated with the symbol selection area;

responsively selecting, by the controller, a symbol for display in the symbol selection area as a function of the selection characteristic;

displaying, by the controller, the selected symbol in the symbol selection area to display the second outcome in the display area, the selected symbol being displayed in each of the adjacent symbol positions included in the symbol selection area, the second outcome including the first outcome and the selected symbol being displayed in the symbol selection area; and providing an award to the player as a function of the second outcome and responsively adjusting the credit balance as a function of the award.

2. A method in accordance with claim 1, comprising the steps of: determining the selection characteristic including a number of symbol positions being displayed in the corresponding symbol selection area; and selecting the symbols as a function of the number of symbol positions being displayed in the corresponding symbol selection area.

3. A method in accordance with claim 1, comprising the step of randomly selecting the symbol as a function of the determined selection characteristic.

4. A method in accordance with claim 1, wherein the selection characteristic includes at least one of a size, shape, and appearance of the symbol selection area.

5. A method in accordance with claim 1 further comprising the step of selecting the symbol from a predefined set of symbols, each symbol in the predefined set of symbols having an corresponding selection probability associated with the symbol characteristic.

6. A method in accordance with claim 1, the method further comprising the step of displaying a frame with the symbol selection area, the frame extending about a perimeter of the symbol positions included within the symbol selection area.

7. A method of allowing a player to play a slot game with a gaming device, comprising the steps of:

displaying, on a display device, a game including a plurality of reels being displayed in a display area, each reel of the plurality of reels including a reel strip including a plurality of symbols positions, at least one reel including a reel strip having at least one symbol selection area, the at least one symbol selection area including a plurality of adjacent symbol positions;

allowing a player, through an input device which accepts physical media indicating a monetary value, to make a wager on the game;

adjusting, by the controller, a credit balance associated with the player as a function of an amount of the wager;

randomly generating, by the controller, an outcome of the game, the outcome including a first outcome and a second outcome;

spinning and stopping the plurality of reels, by the controller, to display the first outcome;

detecting, by the controller, an appearance of a symbol selection area in the first outcome;

displaying, by the controller, a frame with the symbol selection area, the frame extending about a perimeter of the symbol positions included within the symbol selection area;

determining, by the controller, a selection characteristic associated with the symbol selection area, the selection characteristic including a frame color;

determining, by the controller, the frame color being displayed with the symbol selection area;

responsively selecting, by the controller, at least one symbol for display in each of the symbol positions included in the symbol selection area as a function of the selection characteristic including selecting the at least one symbol as a function of the determined frame color;

displaying, by the controller, the at least one symbol in the symbol selection area to display the second outcome in the display area, the second outcome including the first outcome and the selected at least one symbol being displayed in the symbol selection area; and providing an award to the player as a function of the second outcome and responsively adjusting the credit balance as a function of the award.

8. A method in accordance with claim 1, further comprising the steps of:

displaying the game including at least one reel set including an outer reel and an inner reel, the outer reel including the at least one symbol selection area, the inner reel being orientated with respect to the outer reel such that the inner reel is viewable through symbol selection area;

spinning the outer reel and the inner reel from a starting position;

stopping the outer reel to display the first outcome, the spinning inner reel being viewable through the symbol selection area; and stopping the inner reel to display the second outcome.

9. A method in accordance with claim 8, wherein the inner reel includes at least one run of consecutive special symbols positions, each special symbol position of the run of special symbol positions displaying the same symbol.

10. A gaming device, comprising:

an input device which accepts physical media associated with a monetary value to establish a credit balance;

a display device configured to display a game;

a user input device configured to generate a signal indicative of a player's selection input; and a controller coupled to the display device and the user input device, the controller configured to:

display the game on the display device, the game including a plurality of reels being displayed in a display area, each reel of the plurality of reels including a reel strip including a plurality of symbols positions, at least one reel including a reel strip having at least one symbol selection area, the at least one symbol selection area including a plurality of adjacent symbol positions;

allow a player to make a wager on the game with the input device and adjust the credit balance by an amount of the wager;

randomly generate an outcome of the game, the outcome including a first outcome and a second outcome;

spin and stop the plurality of reels to display the first outcome;

detect an appearance of a symbol selection area in the first outcome;

determine a selection characteristic associated with the symbol selection area;

responsively select a symbol for display in the symbol selection area as a function of the selection characteristic;

display the selected symbol in the symbol selection area to display the second outcome in the display area, the selected symbol being displayed in each of the adjacent symbol positions included in the symbol selection area, the second outcome including the first outcome and the selected symbol being displayed in the symbol selection area; and provide an award to the player as a function of the second outcome and responsively adjust the credit balance as a function of the award.

11. A gaming device in accordance with claim 10, the controller configured to:

determine the selection characteristic including a number of symbol positions being displayed in the corresponding symbol selection area; and select the symbols as a function of the number of symbol positions being displayed in the corresponding symbol selection area.

12. A gaming device in accordance with claim 10, wherein the selection characteristic includes at least one of a size, shape, and appearance of the symbol selection area.

13. A gaming device in accordance with claim 10, the controller configured to select symbol from a predefined set of symbols, each symbol in the predefined set of symbols having an corresponding selection probability associated with the symbol characteristic.

14. A gaming device in accordance with claim 10, the controller configured to:

display the game including at least one reel set including an outer reel and an inner reel, the outer reel including the at least one symbol selection area, the inner reel being orientated with respect to the outer reel such that the inner reel is viewable through symbol selection area;

spin the outer reel and the inner reel from a starting position; and stop the outer reel to display the first outcome with the spinning inner reel being viewable through the symbol selection area, and stopping the inner reel to display the second outcome.

15. A gaming device in accordance with claim 14, wherein the inner reel includes at least one run of consecutive special symbols positions, each special symbol position of the run of special symbol positions displaying the same symbol.

16. One or more non-transitory computer-readable storage media, having computer-executable instructions embodied thereon, wherein when executed by at least one processor, the computer-executable instructions cause the processor to:

display, on a display device, a game including a plurality of reels being displayed in a display area, each reel of the plurality of reels including a reel strip including a plurality of symbols positions, at least one reel including a reel strip having at least one symbol selection area, the at least one symbol selection area including a plurality of adjacent symbol positions;

allow a player, through an input device which accepts physical media indicating a monetary value, to make a wager on the game;

adjust a credit balance associated with the player as a function of an amount of the wager;

randomly generate an outcome of the game, the outcome including a first outcome and a second outcome;

spin and stop the plurality of reels to display the first outcome;

detect an appearance of a symbol selection area in the first outcome;

determine a selection characteristic associated with the symbol selection area;

responsively select symbol for display in the symbol selection area as a function of the selection characteristic;

display the selected symbol in the symbol selection area to display the second-outcome in the display area, the selected symbol being displayed in each of the adjacent symbol positions included in the symbol selection area, the second outcome including the first outcome and the selected symbol being displayed in the symbol selection area; and provide an award to the player as a function of the second outcome and responsively adjust the credit balance as a function of the award.

17. The one or more computer-readable storage media according to claim 16, wherein the computer-executable instructions cause the processor to:

determine the selection characteristic including a number of symbol positions being displayed in the corresponding symbol selection area; and select the symbols as a function of the number of symbol positions being displayed in the corresponding symbol selection area.

18. The one or more computer-readable storage media according to claim 16, wherein the selection characteristic includes at least one of a size, shape, and appearance of the symbol selection area.

19. The one or more computer-readable storage media according to claim 16, wherein when executed by at least one processor, the computer-executable instructions cause the processor to:

display the game including at least one reel set including an outer reel and an inner reel, the outer reel including the at least one symbol selection area, the inner reel being orientated with respect to the outer reel such that the inner reel is viewable through symbol selection area;

spin the outer reel and the inner reel from a starting position;

stop the outer reel to display the first outcome, the spinning inner reel being viewable through the symbol selection area; and stop the inner reel to display the second outcome.

20. The one or more computer-readable storage media according to claim 19, wherein the inner reel includes at least one run of consecutive special symbols positions, each special symbol position of the run of special symbol positions displaying the same symbol.

21. A gaming device, comprising:

an input device which accepts physical media associated with a monetary value to establish a credit balance;

a display device configured to display a game;

a user input device configured to generate a signal indicative of a player's selection input; and a controller coupled to the display device and the user input device, the controller configured to:

display the game on the display device, the game including a plurality of reels being displayed in a display area, each reel of the plurality of reels including a reel strip including a plurality of symbols positions, at least one reel including a reel strip having at least one symbol selection area, the at least one symbol selection area including a plurality of adjacent symbol positions;

allow a player to make a wager on the game with the input device and adjust the credit balance by an amount of the wager;

randomly generate an outcome of the game, the outcome including a first outcome and a second outcome;

spin and stop the plurality of reels to display the first outcome;

detect an appearance of a symbol selection area in the first outcome;

display a frame with the symbol selection area, the frame extending about a perimeter of the symbol positions included within the symbol selection area;

determine a selection characteristic associated with the symbol selection area, the selection characteristic including a frame color;

determine the frame color being displayed with the symbol selection area;

responsively select at least one symbol for display in each of the symbol positions included in the symbol selection area as a function of the selection characteristic including selecting the at least one symbol as a function of the determined frame color;

display the at least one symbol in the symbol selection area to display the second outcome in the display area, the second outcome including the first outcome and the selected at least one symbol being displayed in the symbol selection area; and provide an award to the player as a function of the second outcome and responsively adjust the credit balance as a function of the award.

22. One or more non-transitory computer-readable storage media, having computer-executable instructions embodied thereon, wherein when executed by at least one processor, the computer-executable instructions cause the processor to:

display, on a display device, a game including a plurality of reels being displayed in a display area, each reel of the plurality of reels including a reel strip including a plurality of symbols positions, at least one reel including a reel strip having at least one symbol selection area, the at least one symbol selection area including a plurality of adjacent symbol positions;

allow a player, through an input device which accepts physical media indicating a monetary value, to make a wager on the game;

adjust a credit balance associated with the player as a function of an amount of the wager;

randomly generate an outcome of the game, the outcome including a first outcome and a second outcome;

spin and stop the plurality of reels to display the first outcome;

detect an appearance of a symbol selection area in the first outcome;

display a frame with the symbol selection area, the frame extending about a perimeter of the symbol positions included within the symbol selection area;

determine a selection characteristic associated with the symbol selection area, the selection characteristic including a frame color;

determine the frame color being displayed with the symbol selection area;

responsively select at least one symbol for display in each of the symbol positions included in the symbol selection area as a function of the selection characteristic including selecting the at least one symbol as a function of the determined frame color;

display the at least one symbol in the symbol selection area to display the second outcome in the display area, the second outcome including the first outcome and the selected at least one symbol being displayed in the symbol selection area; and provide an award to the player as a function of the second outcome and responsively adjust the credit balance as a function of the award.

* * * * *